US012668746B2

(12) United States Patent
West

(10) Patent No.: US 12,668,746 B2
(45) Date of Patent: Jun. 30, 2026

(54) SYSTEM FOR MANUFACTURING BIOCHAR AND METHOD THEREOF

(71) Applicant: Gordon West, Silver City, NM (US)

(72) Inventor: Gordon West, Silver City, NM (US)

( * ) Notice: Subject to any disclaimer, the term of this patent is extended or adjusted under 35 U.S.C. 154(b) by 224 days.

(21) Appl. No.: 18/341,177

(22) Filed: Jun. 26, 2023

(65) Prior Publication Data

US 2024/0043750 A1 Feb. 8, 2024

Related U.S. Application Data

(60) Provisional application No. 63/394,801, filed on Aug. 3, 2022.

(51) Int. Cl.

| | |
|---|---|
| ***C10B 53/02*** | (2006.01) |
| ***C10B 3/02*** | (2006.01) |
| ***C10B 7/10*** | (2006.01) |
| ***C10B 21/18*** | (2006.01) |
| ***C10B 27/06*** | (2006.01) |
| ***C10B 31/06*** | (2006.01) |
| ***C10B 33/08*** | (2006.01) |
| ***C10B 49/02*** | (2006.01) |

(52) U.S. Cl.

CPC ..... *C10B 53/02* (2013.01); *C10B 3/02* (2013.01); *C10B 7/10* (2013.01); *C10B 21/18* (2013.01); *C10B 27/06* (2013.01); *C10B 31/06* (2013.01); *C10B 33/08* (2013.01); *C10B 49/02* (2013.01)

(58) Field of Classification Search

CPC .. C10B 3/02; C10B 7/10; C10B 21/18; C10B 27/06; C10B 31/06; C10B 33/08; C10B 49/02; C10B 53/02

See application file for complete search history.

(56) References Cited

U.S. PATENT DOCUMENTS 4,225,392 A * 9/1980 Taylor ..... C10B 1/04 48/85
5,198,018 A * 3/1993 Agarwal ..... C10B 7/10 75/401
8,206,471 B1 * 6/2012 Tharpe, Jr. ..... C10B 49/20 48/209

(Continued)

FOREIGN PATENT DOCUMENTS

EP 3760693 A1 * 1/2021 ..... C10B 49/04

OTHER PUBLICATIONS

ESPACENET Machine Translation of EP3760693 Obtained Apr. 1, 2025 (Year: 2025).*

*Primary Examiner* — Jonathan Miller
(74) *Attorney, Agent, or Firm* — Sand, Sebolt & Wernow Co., LPA

(57) ABSTRACT

A pyrolysis system for synthesizing and utilizing synthesized gas and synthesized biochar material. The pyrolysis system may include at least one hopper configured to hold biomass. The pyrolysis system may also include at least one top-lit up-draft pyrolyzer operably engaged with the at least one hopper and configured to receive the biomass from the at least one hopper at a feeding rate to convert the biomass into a first byproduct and a second byproduct different than the first byproduct. The pyrolysis system may also include at least one static mixer operably engaged with the at least one conically-shaped pyrolyzer and configured to convert the first byproduct to a combustion energy source.

16 Claims, 10 Drawing Sheets

(56) References Cited

U.S. PATENT DOCUMENTS

| | | | | |
|---|---|---|---|---|
| 8,353,973 | B2 * | 1/2013 | Tharpe, Jr. | C10C 5/00 48/197 FM |
| 8,772,559 | B2 * | 7/2014 | Smaidris | C10C 5/00 585/242 |
| 8,968,520 | B2 * | 3/2015 | Coolidge | C10B 57/10 201/37 |
| 9,068,121 | B1 * | 6/2015 | Tharpe, Jr. | C10B 31/06 |
| 9,464,234 | B1 * | 10/2016 | Tharpe, Jr. | C10B 49/08 |
| 9,719,020 | B1 * | 8/2017 | Tharpe, Jr. | C10B 47/06 |
| 10,851,305 | B2 * | 12/2020 | Hallowell | C10L 5/447 |
| 2008/0006520 | A1 * | 1/2008 | Badger | C10B 51/00 202/202 |
| 2008/0202983 | A1 * | 8/2008 | Smith | C10B 53/07 422/198 |
| 2010/0132258 | A1 * | 6/2010 | Linck | C10B 7/02 48/197 FM |
| 2013/0133560 | A1 * | 5/2013 | Laskowski | F23B 90/02 110/258 |
| 2013/0299332 | A1 * | 11/2013 | Smaidris | C10C 5/00 201/1 |
| 2016/0068757 | A1 * | 3/2016 | Cui | C10J 3/723 202/117 |
| 2024/0043750 | A1 * | 2/2024 | West | C10B 49/04 |
| 2024/0301293 | A1 * | 9/2024 | Tharpe, Jr. | C10B 49/04 |

* cited by examiner

SYSTEM FOR MANUFACTURING BIOCHAR AND METHOD THEREOF

REFERENCE TO RELATED APPLICATIONS

This application claims the benefit of U.S. Provisional Application Ser. No. 63/394,801, filed on Aug. 3, 2022; the disclosure of which is incorporated herein by reference.

TECHNICAL FIELD

This disclosure is directed to a continuous pyrolysis system for synthesizing and utilizing synthesized gas and synthesized biochar material.

BACKGROUND ART

The impacts of climate change are accelerating annually due to dramatic changes in extreme heat, extreme weather, greater rates of wildfires, coral reef die-offs, and other dramatic climate changes of the like. To stop and/or reverse these global warming issues, solutions of recapturing carbon from the atmosphere and surrounding environments while annually sequestering this captured carbon back into the environment are becoming some of the most viable solutions available.

Currently, bioenergy solutions are being used throughout the world for recapturing and sequestering carbon back into the environment. One popular bioenergy solution is the use of biochar solutions and/or systems. Such biochar solutions and/or system may be used to displace the use of high fossil fuel emissions and to produce a sequestered carbon byproduct that can be used to leverage additional carbon capturing. The biochar solutions may use various types of biomass materials and/or biomass waste material including, but not limited to, wood (urban or wildland), agricultural waste (such as cotton, rice, grass, or hemp), demolition material, and other suitable biomass material and/or biomass waste of the like. Conventionally, however, these systems only produce a limited volume of biochar material during a single pyrolysis process due to conventional production methods and techniques. With such lack of production, these conventional biochar solutions and/or systems take extensive periods of production time to synthesize biochar material that can be sequestered back into the environment at an impactful, worldwide scale. Moreover, it is common for these biochar solutions and/or system to simply exhaust synthesized gas back into the environment without sequestering such carbon.

SUMMARY OF THE INVENTION

The presently disclosed continuous pyrolysis system (CPS) is configured to produce biochar material from biomass material at a continuous rate as compared to the conventional batch process solutions. The disclosed CPS is also configured to capture synthesized gas produced during the pyrolysis processes and be reused as a fuel source and/or an energy source for various apparatuses and machines operably engaged with the presently disclosed CPS. One exemplary embodiment of a CPS also includes a top-lit updraft pyrolyzer defining a conically-shaped inner wall to reduce and/or eliminate binding of biomass material inside of the pyrolyzer during continuous pyrolysis processes. As such, the CPS disclosed herein addresses some of the inadequacies of previously known pyrolysis systems and devices thereof.

In one aspect, an exemplary embodiment of the present disclosure may provide a continuous flow CPS. The CPS may include at least one hopper configured to hold a predetermined amount of biomass. The CPS may also include at least one pyrolyzer operably engaged with the at least one hopper and configured to receive a continuous amount of biomass from the at least one hopper at a feeding rate to convert the continuous amount of biomass into a first byproduct and a second byproduct different than the first byproduct. The CPS may also include at least one heat exchanger operably engaged with the at least one pyrolyzer and configured to receive the first byproduct synthesized by the at least one pyrolyzer. The CPS may also include at least one biochar quencher operably engaged with the at least one pyrolyzer and configured to receive the second byproduct synthesized by the at least one pyrolyzer.

In another aspect, an exemplary embodiment of the present disclosure may provide a continuous flow CPS. The CPS may include at least one hopper configured to hold a predetermined amount of biomass. The CPS may also include at least one frustoconically-shaped pyrolyzer operably engaged with the at least one hopper and configured to receive a continuous amount of biomass from the at least one hopper at a feeding rate to convert the continuous amount of biomass into a first byproduct and a second byproduct different than the first byproduct. The CPS may also include at least one static mixer operably engaged with the at least one conically-shaped pyrolyzer and configured to convert the first byproduct to a combustion energy source. CPS may also include at least one heat exchanger operably engaged with the at least one burner and configured to receive the combustion energy source. The CPS may also include at least one biochar quencher operably engaged with the at least one pyrolyzer and configured to receive the second byproduct produced by the at least one pyrolyzer.

In another aspect, an exemplary embodiment of the present disclosure may provide a method. The method comprises steps of feeding a continuous amount of biomass at a feeding rate from at least one hopper, via at least one auger, into a first portion of at least one pyrolyzer; feeding the continuous amount of biomass into a second portion of the at least one pyrolyzer, via at least another auger, at the feeding rate; initiating a pyrolysis process inside the at least one pyrolyzer; producing a first byproduct, via the at least one pyrolyzer, from the continuous amount of biomass; and producing a second byproduct, via the at least one pyrolyzer, from the continuous amount of biomass.

In yet another aspect, an exemplary embodiment of the present disclosure may provide a pyrolysis system. The pyrolysis system includes at least one hopper that is configured to hold biomass. The pyrolysis system also includes at least one pyrolyzer that operably engages with the at least one hopper and is configured to receive the biomass from the at least one hopper at a feeding rate to convert the biomass into a first byproduct and a second byproduct that is different than the first byproduct. The pyrolysis system also includes at least one heat exchanger that operably engages with the at least one pyrolyzer and is configured to receive the first byproduct that is synthesized by the at least one pyrolyzer. The pyrolysis system also includes at least one biochar quencher that operably engages with the at least one pyrolyzer and is configured to receive the second byproduct synthesized by the at least one pyrolyzer at the feeding rate.

This exemplary embodiment or another exemplary embodiment may further include that the at least one pyrolyzer comprises: a main body for storing the biomass and synthesizing the biomass into the first byproduct and the second byproduct, the main body comprises: a top end defining a first diameter; a bottom end defining a second diameter that is less than the first diameter; and at least one wall extending between the top end and the bottom end and defining a chamber therebetween; wherein the at least one wall defines a frustoconical shape between the top end and the bottom end. This exemplary embodiment or another exemplary embodiment may further include that the at least one pyrolyzer further comprises: a base operably engaged with the bottom end of the main body; wherein the base is configured to feed the biomass into the chamber of the main body at the bottom end at the feeding rate. This exemplary embodiment or another exemplary embodiment may further include that the at least one pyrolyzer further comprises: a collar operably engaged with the top end of the main body; and a hood operably engaged with the collar and positioned vertically above the top end of the main body; wherein the hood is configured to direct the first byproduct to the at least one heat exchanger; and wherein the collar is configured to direct the second byproduct to the at least one biochar quencher. This exemplary embodiment or another exemplary embodiment may further include that the hood comprises: a top end of the hood defining a top opening with a first diameter; a bottom end of the hood defining a bottom opening with a second diameter that is greater than the first diameter; and at least one wall of the hood extending between the top end and the bottom end and defining a chamber therebetween; wherein the at least one wall of the hood defines a frustoconical shape between the bottom end and the top end. This exemplary embodiment or another exemplary embodiment may further include a first auger operably engaged with and positioned inside of a first pipe connection for feeding the biomass from the hopper to the at least one pyrolyzer at the feeding rate; and a second auger operably engaged with and positioned inside of the at least one pyrolyzer for feeding the biomass from the first auger into the at least one pyrolyzer at the feeding rate. This exemplary embodiment or another exemplary embodiment may further include a wiper assembly operably engaged with the second auger and positioned inside of the at least one pyrolyzer; wherein the wiper assembly is configured to move the second byproduct from the at least one pyrolyzer to the at least one biochar quencher at the feeding rate. This exemplary embodiment or another exemplary embodiment may further include a burner operably engaged with the at least one pyrolyzer and the at least one heat exchanger by a pipe connection; wherein the burner is configured to mix external combustion air produced by the at least one heat exchanger with the first byproduct synthesized by the at least one pyrolyzer. This exemplary embodiment or another exemplary embodiment may further include that the burner comprises: a first pipe operably engaged with the pipe connection and the at least one heat exchanger; a second pipe operably engaged with the first pipe and in fluid communication with the first pipe by a set of openings defined along a portion of the second pipe; an external air connection operably engaged with the second pipe and in fluid communication with the second pipe by the set of openings to deliver the external combustion air; and a fan operably engaged with the external air connection to input the external combustion air through the set of openings defined in the second pipe. This exemplary embodiment or another exemplary embodiment may further include that the burner comprises: a first pipe operably engaged with the pipe connection and the at least one heat exchanger; a second pipe operably engaged with the first pipe and in fluid communication with the first pipe by a set of openings defined along an entire length of the second pipe; an external air connection operably engaged with the second pipe and in fluid communication with the second pipe by the set of openings to deliver the external combustion air; and a fan operably engaged with the external air connection to input the external combustion air through the set of openings defined in the second pipe. This exemplary embodiment or another exemplary embodiment may further include that the burner comprises: a first pipe operably engaged with the pipe connection and the at least one heat exchanger; a second pipe operably engaged with the first pipe and in fluid communication with the first pipe; a third pipe operably engaged with and in fluid communication with the second pipe and defining a set of openings; an external air connection operably engaged with the third pipe and in fluid communication with the third pipe by the set of openings to deliver the external combustion air; and a fan operably engaged with the external air connection to input the external combustion air through the set of openings. This exemplary embodiment or another exemplary embodiment may further include that the burner comprises: a first pipe operably engaged with the pipe connection and the at least one heat exchanger; a second pipe operably engaged with the first pipe and in fluid communication with the first pipe; a third pipe operably engaged about and in fluid communication with the second pipe and defining a set of openings; an external air connection operably engaged with the third pipe and in fluid communication with the third pipe by the set of openings to deliver the external combustion air; and a fan operably engaged with the external air connection to input the external combustion air through the set of openings. This exemplary embodiment or another exemplary embodiment may further include an igniter operably engaged with the at least one wall of the hood between the top end and the bottom end; wherein the igniter is configured to ignite the biomass inside of the at least one pyrolyzer. This exemplary embodiment or another exemplary embodiment may further include that the at least one pyrolyzer is a top-lit up-draft style pyrolyzer.

In yet another aspect, an exemplary embodiment of the present disclosure may provide a method. The method includes steps of: feeding biomass at a feeding rate from at least one hopper, via at least one auger, into a base of at least one pyrolyzer; feeding the biomass from the base and into a main body of the at least one pyrolyzer, via at least another auger, at the feeding rate; initiating a pyrolysis process inside the at least one pyrolyzer by an igniter; producing a first byproduct, via the at least one pyrolyzer, from the biomass; and producing a second byproduct, via the at least one pyrolyzer, from the biomass, wherein the second byproduct is different than the first byproduct.

This exemplary embodiment or another exemplary embodiment may further include a step of monitoring a pyrolysis zone of the pyrolysis process, by a control system, inside of the at least one pyrolyzer. This exemplary embodiment or another exemplary embodiment may further include a step of maintaining one or both of the at least one auger and the at least another auger at the feeding rate, via the control system, when the pyrolysis zone is at a desired thermocouple of a set of thermocouples of the control system, wherein the feeding rate is continuous. This exemplary embodiment or another exemplary embodiment may further include a step of altering one or both of the at least one auger and the at least another auger from the feeding rate to a second feeding rate, via the control system, when the pyrolysis zone is one of below or above a desired thermocouple of a set of thermocouples of the control system;

wherein the second feeding rate is different than the feeding rate. This exemplary embodiment or another exemplary embodiment may further include a step of moving the first byproduct, by a wiper assembly, from the at least one pyrolyzer to at least one biomass quencher. This exemplary embodiment or another exemplary embodiment may further include steps of capturing the second byproduct by a hood of the at least one pyrolyzer; mixing the second byproduct with external combustion air from a burner to create combustion energy; and outputting the combustion energy from the burner to at least one heat exchanger.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

FIGS. 1A-3 illustrate a continuous pyrolysis system (or CPS) generally referred to as 1. CPS 1 enables a continuous feed of biomass material, or similar renewable organic material, to be synthesized into an energy source and a biochar material or residue synthesized after the pyrolysis process. Such syntheses of energy and biochar material produced by CPS 1 through a continuous feed of biomass material are described in more detail below. Additionally, any suitable biomass material may be used in CPS 1 to create energy and biochar material. Suitable biomass material that may be used in a CPS described and illustrated herein includes wood and wood processing wastes, agricultural crops and waste materials, biogenic material, and other biomass material of the like to create energy and biochar material. The assemblies and components that form CPS 1 are described in more detail below.

Figure 1A:
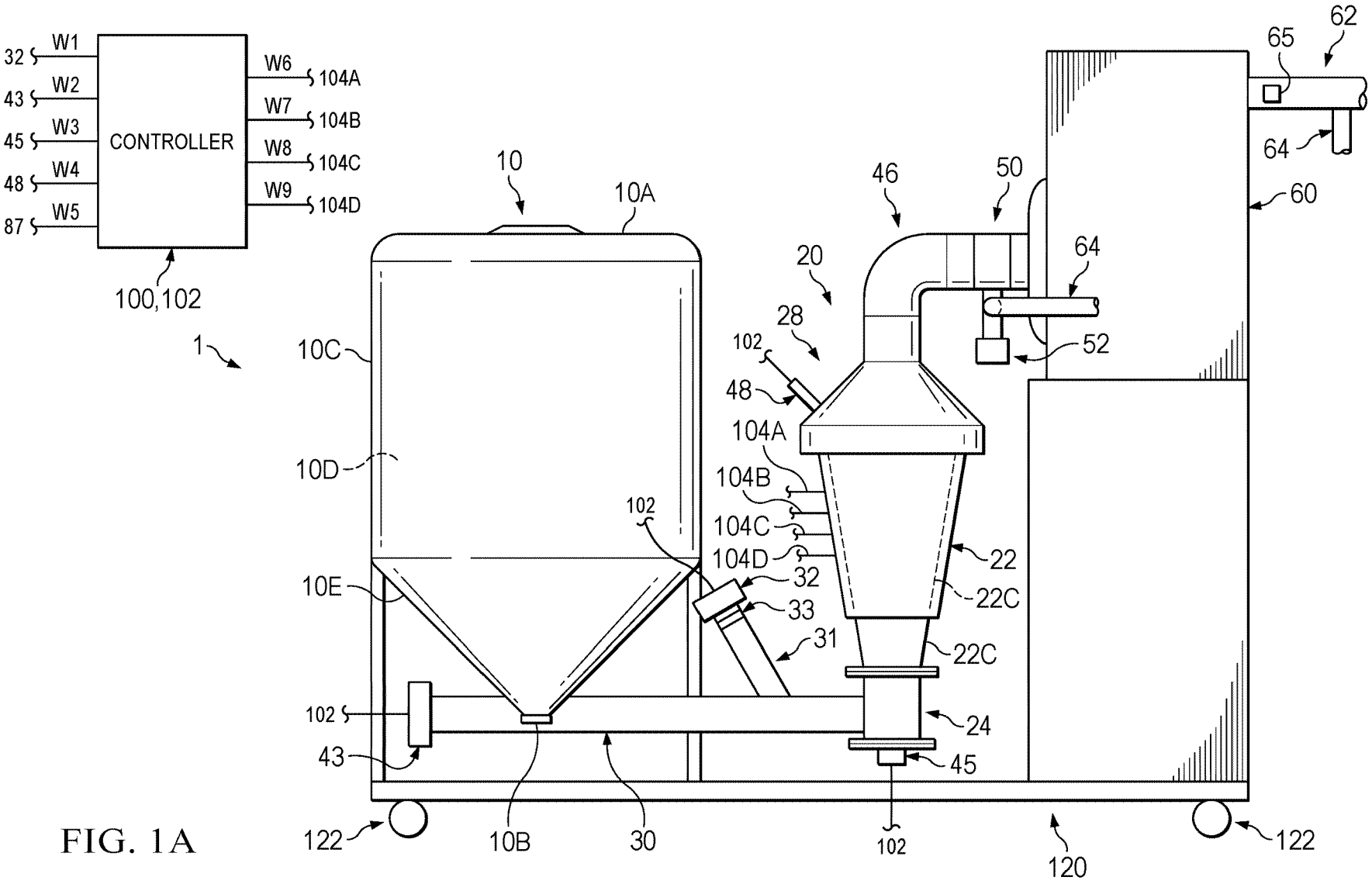
FIG. 1A is a diagrammatic side elevation view of a continuous pyrolysis system (CPS) in accordance with an aspect of the present disclosure.
Figure 1B:
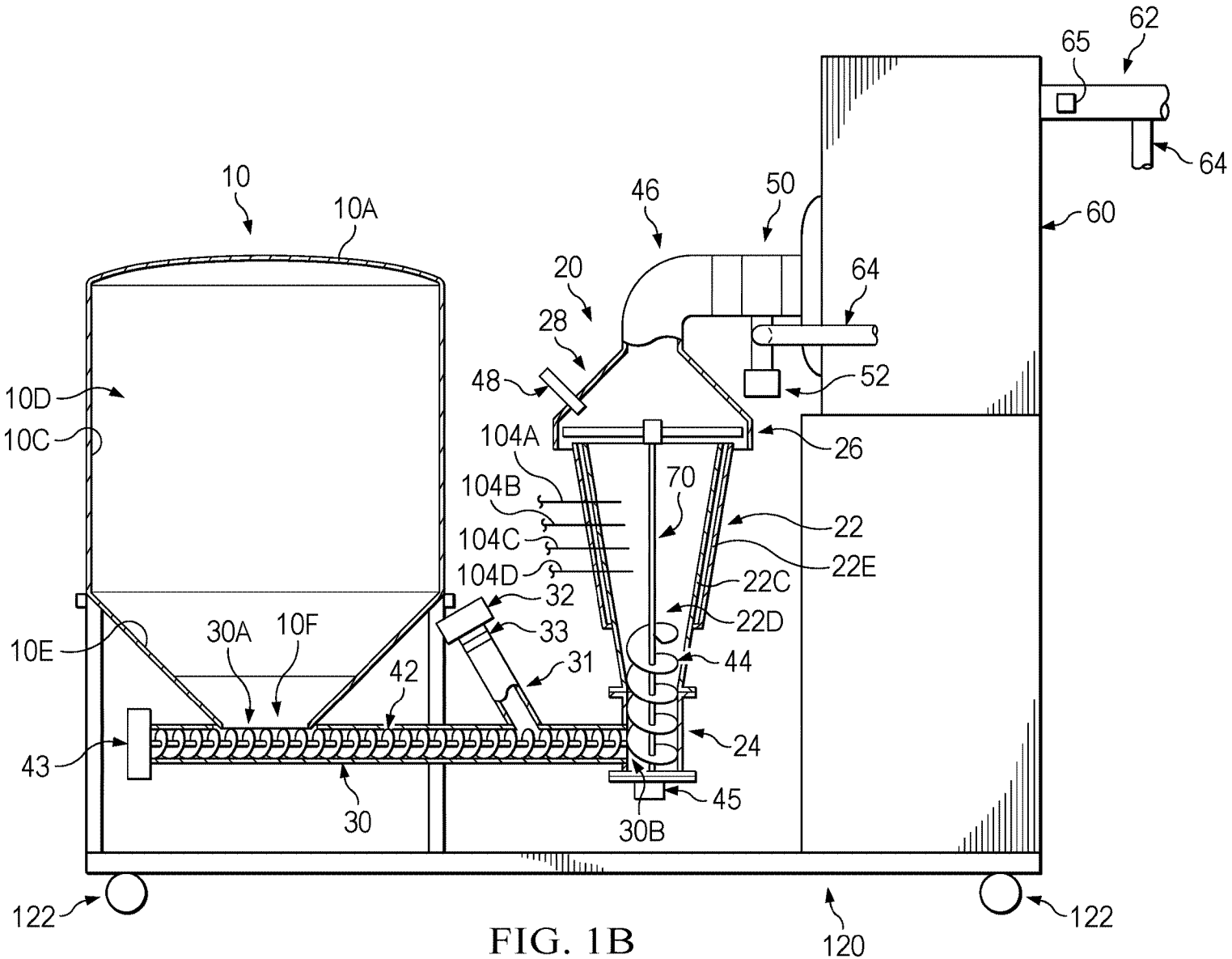
FIG. 1B is a diagrammatic cross-sectional view of CPS shown in FIG. 1A.

Referring to FIGS. 1A-1B, CPS 1 includes at least one hopper 10 that is configured to hold a predetermined amount of biomass for continuous pyrolysis processes. In the illustrated embodiment, CPS 1 includes one hopper 10 that is configured to hold a predetermined amount of biomass for pyrolysis processes. It should be understood that any suitable hopper may be used herein for holding a predetermined amount of biomass for pyrolysis processes. In other exemplary embodiments, any suitable number of hoppers may be used in a CPS described and illustrated herein for holding a predetermined amount of biomass for continuous pyrolysis processes.

Still referring to FIG. 1A, the hopper 10 has a top end 10A, a bottom end 10B opposite to the top end 10A, a circumferential wall 10C extending between the top end 10A and the bottom end 10B, and a chamber 10D defined collectively by the circumferential wall 10C and extending between the top end 10A and the bottom end 10B. The hopper 10 may also include a funnel portion 10E inside of the chamber 10D. The funnel portion 10E may extend vertically downward from a position on the circumferential wall 10C to a bottom or dispensing opening 10F defined at the bottom end 10B (see FIG. 1B). The funnel portion 10E may be configured to guide and/or funnel biomass material from the top end 10A of the hopper 10 towards to the bottom opening 10F.

Still referring to FIG. 1, CPS 1 also includes at least one pyrolyzer 20 that operably engages with the at least one hopper 10 and is in fluid communication with the at least one hopper 10. In the illustrated embodiment, a single pyrolyzer 20 is provided in CPS 1 that operably engages with the hopper 10 and is in fluid communication with the hopper 10. In other exemplary embodiments, any suitable number of pyrolyzers may be provided in a CPS described and illustrated herein depending on various considerations, including the number of pyrolysis processes desired to be performed. As described in more detail below, the pyrolyzer 20 is configured to produce and/or synthesize a first byproduct or synthesis gas when performing a continuous pyrolysis process from biomass material. As also described in more detail below, the pyrolyzer 20 is also configured to produce and/or synthesis a second byproduct or biochar material when performing a continuous pyrolysis process from biomass material. The assemblies and components of the pyrolyzer 20 are described in more detail below.

Figure 1C:
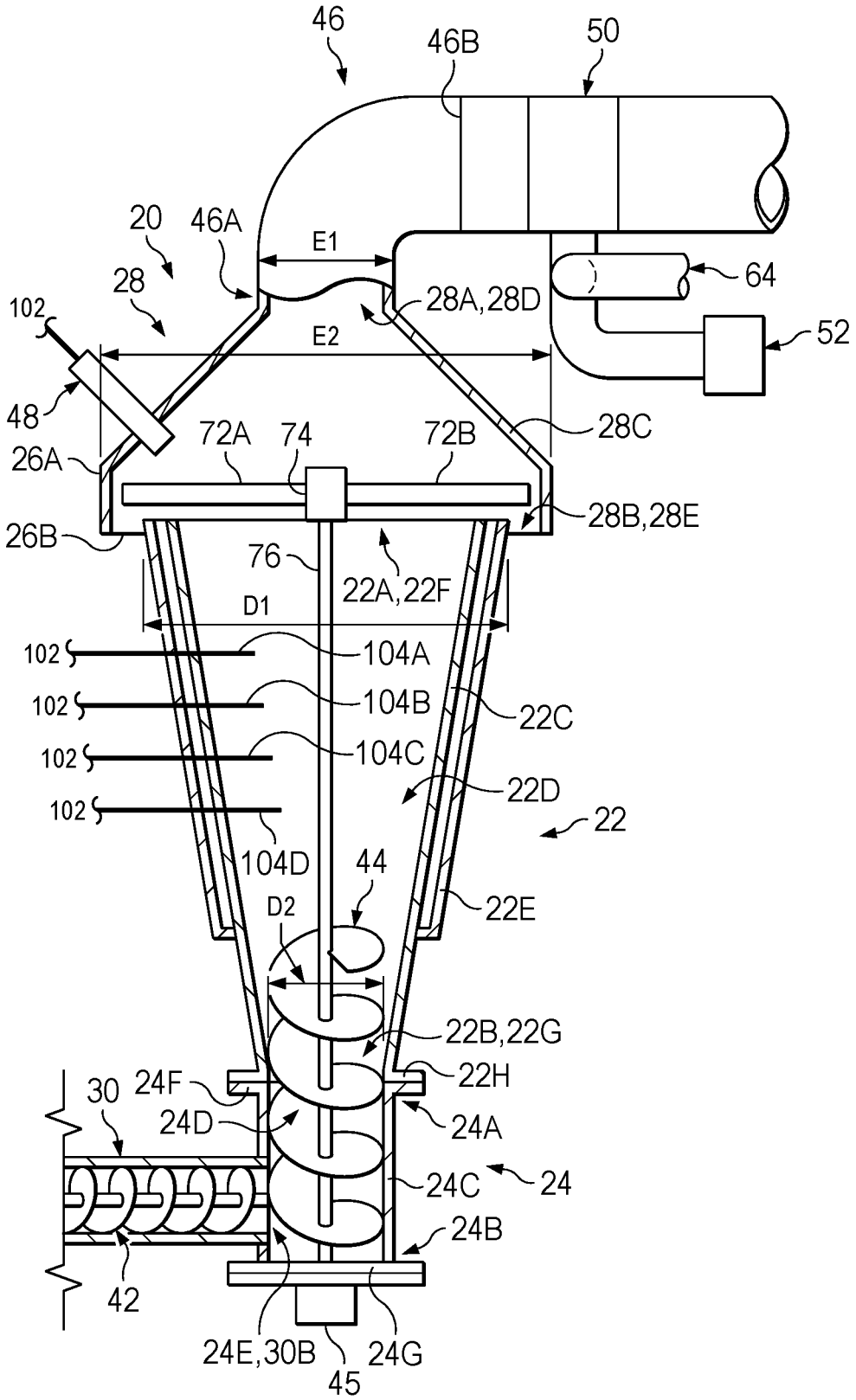
FIG. 1C is an enlargement of CPS shown in FIG. 1A.

The pyrolyzer 20 may include a main body 22. As best seen in FIG. 1C, the main body 22 includes a top end 22A, a bottom end 22B opposite to top end 22A, and an inner circumferential wall 22C extending between the top end 22A and the bottom end 22B of the main body 22. The main body 22 also includes a chamber 22D defined by the inner circumferential wall 22C and extends between the top end 22A and the bottom end 22B. The main body 22 may also include an outer circumferential wall 22E that extends between the top end 22A and the bottom end 22B of the main body 22 where outer circumferential wall 22E is defined circumferentially about the inner circumferential wall 22C exterior to the chamber 22D. Such inclusion of the inner circumferential wall 22C and the outer circumferential wall 22E may provide insulation properties to retain heat inside of the main body 22 during pyrolysis processes.

As best seen in FIG. 1C, the inner circumferential wall 22C may also define a top opening 22F at the top end 22A of the main body 22 defining a first diameter D1. The inner circumferential wall 22C may also define a bottom opening 22G at the bottom end 22B of the main body 22 defining a second diameter D2 where the first diameter D1 is greater than the second diameter D2. Such size differences between the top opening 22F and the bottom opening 22G enables the main body 22, or at least the inner surface of the main body 22, to define a conical shape or frustoconical shape that tapers downwardly along the main body 22 from the top end 22A to the bottom end 22B. As such, the inner circumferential wall 22C defines the conical shape or frustoconical shape that tapers downwardly from the top end 22A to the bottom end 22B interior to the chamber 22D. Similarly, the outer circumferential wall 22E also defines the conical shape or frustoconical shape that tapers downwardly from the top end 22A to the bottom end 22B exterior to the chamber 22D. However, it is possible for the outer wall 22E to take on a different configuration even when the inner circumferential wall 22C is conical. The conical shape or frustoconical shape of the main body 22, or at least wall 22C, is considered advantageous at least because the conical shape enables biomass material to travel upwardly from the bottom end 22B to the top end 22A without being trapped, wedged, and/or compacted inside of the main body 22 during pyrolysis processes. Stated differently, the conical shape or frustoconical shape of the inner circumferential wall 22C enables the biomass material to travel upwardly along inner circumferential wall 22C inside of the chamber 22D with ease to enable the pyrolyzer 22 to evenly synthesize the biomass material to biochar material during pyrolysis processes, which are described in more detail below.

Still referring to FIG. 1C, the main body 22 may also include a flange 22H. The flange 22H is operably engaged with the inner circumferential wall 22C at the bottom end 22B of the main body 22. As described in further detail below, the flange 22H enables the main body 22 to operably engage with another member of the pyrolyzer 20 for feeding biomass material into the main body 22 during pyrolysis processes.

Still referring to FIG. 1, the pyrolyzer 20 also includes a base 24 operably engaged with the main body 22. More particularly, the base 24 is operably engaged with flange 22H of the main body 22 in which the base 24 is positioned vertically below the main body 22. The base 24 includes a top end 24A positioned proximate to the bottom end 22B of the main body 22, a bottom end 24B opposite to the top end 24A, a circumferential wall 24C extending between the top end 24A and the bottom end 24B, and a chamber 24D defined inside of the circumferential wall 24C and extending between the top end 24A and the bottom end 24B. The base 24 also defines a side opening 24E that extends entirely through the circumferential wall 24C in which the chamber 24D of the base 24 in fluid communication with the exterior environment of the base 24 via the side opening 24E. As described in more detail below, the side opening 24E enables at least one pipe connection to operably engage the base 24 and the hopper 10 with one another for feeding and/or transporting biomass material from the hopper 10 to the pyrolyzer 20.

Still referring to FIG. 1, the base 24 may also include an upper flange 24F that is positioned at the top end 24A of the base 24. The upper flange 24F is configured to operably engage with the flange 22H of the main body 22 when the pyrolyzer 20 is assembled. As such, connectors (not illustrated) may operably engage the upper flange 24F and the flange 22H with one another to operably engage the base 24 and the main body 22 with one another. The base 24 may also include a lower flange 24G that is positioned at the bottom end 24B of the base 24. While not illustrated herein, the lower flange 24G may be configured to operably engage the pyrolyzer 20 with a support structure of CPS 1 or a ground support surface.

Upon assembly of the main body 22 and the base 24, the chamber 22D of the main body 22 and the chamber 24D of the base 24 are in fluid communication with one another. As described in more detail below, the base 24 is configured to feed and deliver biomass material into the main body 22 due to the fluid communication between the chamber 24D and the chamber 22D.

As illustrated in FIG. 1, the base 24 may define a substantially cylindrical shape that extends between the top end 24A and the bottom end 24B. As such, base 24 may define a different shape than the main body 22. In another exemplary embodiment, a base of a pyrolyzer described and illustrated herein may define any suitable shape. In one exemplary embodiment, a base of a pyrolyzer may define a shape that is complementary to a shape defined by a main body of the pyrolyzer. In another exemplary embodiment, a base of a pyrolyzer may define a shape that is different than a shape defined by a main body of the pyrolyzer.

Still referring to FIG. 1C, the pyrolyzer 20 includes a collar 26 that operably engages with the main body 22. More particularly, the collar 26 operably engaged with the main body 22 at the top end 22A and is positioned vertically above the main body 22. The collar 26 includes a base wall 26A that operably engages with the top end 22A of the main body 22. The collar 26 also includes a circumferential wall 26B that extends vertically upward from the base wall 26A and vertically away from the top end 22A of the main body 22. The collar 26 may also define a side opening 26C in one or both of the base wall 26A and the circumferential wall 26B (see FIG. 2). As illustrated, a portion of the base wall 26A defines the side opening 26C, and a portion of the circumferential wall 26B also defines the side opening 26C. As described in more detail below, the side opening 26C enables the pyrolyzer 20 to eject and/or dispense biochar material from the pyrolyzer as the biochar material is synthesized during pyrolysis processes.

The collar 26 of the pyrolyzer 20 may be operably engaged with the main body 22 in any suitable way. In the illustrated embodiment, the collar 26 is operably engaged with the main body 22 at the top end 22A in which the collar 26 and the main body 22 are separate and independent components. In one exemplary embodiment, a collar described and illustrated herein may be a part of a main body of a pyrolyzer in that the collar and the main body form a single, monolithic member for the pyrolyzer.

Still referring to FIG. 1C, the pyrolyzer 20 may also include a hood 28 that operably engages with the collar 26. More particularly, the hood 28 operably engages with and rests on the circumferential wall 26B of the collar 26. The hood 28 includes a top end 28A remote from the collar 26, a bottom end 28B operably engaged with the circumferential wall 26B of the collar 26 and opposite to the top end 28A, and a circumferential wall 28C extending between the top end 28A and the bottom end 28B. The circumferential wall 28C may define a top opening 28D at the top end 28A of the hood 28 having a first diameter E1. The circumferential wall 28C may also define a bottom opening 28E at the bottom end 28B of the hood 28 having a second diameter E2 where the second diameter E2 is greater than the first diameter E1. With such different dimensions of the top opening 28D and the bottom opening 28E, the hood 28 defines a substantially conical shape that tapers outwardly from the top end 22A to the bottom end 28B. Such conical shaped defined by the hood 28 enables the hood 28 to trap and funnel synthesized fumes and gas from the pyrolyzer 20 to a burner of CPS 1, which is described in more detail below.

In one particular embodiment, the pyrolyzer 20 may be a top-lit updraft (TLUD) pyrolyzer 20. As such, the pyrolysis processes of CPS 1 begin when an operator of CPS 1 ignites the biomass material at the top end 22A of the main body 22 via an ignitor or similar device of the like, which is described in more detail below.

Still referring to FIGS. 1A-1C, CPS 1 also includes a first pipe connection 30 operably engaged with hopper 10 and the pyrolyzer 20 to provide fluid communication between the hopper 10 and the pyrolyzer 20. As illustrated in FIG. 1B, an inlet end 30A of the first pipe connection 30 is operably engaged with hopper 10 at the bottom end 10B where the inlet end 30A is in fluid communication with the bottom opening 10F of hopper 10. An outlet end 30B of the first pipe connection 30 also operably engages with the pyrolyzer 20 at the base 24 in which the outlet end 30B is in fluid communication with the side opening 24E (see FIG. 1C). Upon this configuration, the first pipe connection 30 is in fluid communication with the chamber 10D of the hopper 10, via the bottom end 10F, and the chambers 22D, 24D of the pyrolyzer 20, via the side opening 24E. As described in further detail below, the first pipe connection 30 is configured to enable feeding and/or transporting of biomass material from the hopper 10 to the pyrolyzer 20 via at least one auger of the CPS 1 rotatably engaged with the first pipe connection 30.

Referring to FIGS. 1A-1B, a Y-fitting 31 may be operably engaged with the first pipe connection 30 at a position between the inlet end 30A and the outlet end 30B. The Y-fitting 31 is also in fluid communication with the first pipe connection 30 which enables to the Y-fitting 31 to be in fluid communication with one or both of the hopper 10 and the pyrolyzer 20. A fan or air blower 32 may be operably engaged with the Y-fitting 31 to force external air through the first pipe connection 30 and into the pyrolyzer 20 for assistance during pyrolysis processes, which is described in more detail below. Still referring to FIG. 1, a valve 33 may also be operably engaged with the Y-fitting 31 downstream of the air blower 32 to enable air to flow through the Y-fitting 31 and into the first pipe connection 30 or to disable air to flow through the Y-fitting 31 and into the first pipe connection 30. In an opened position, the valve 33 enables air to flow through the Y-fitting 31 and into the first pipe connection 30 and the pyrolyzer 20. In a closed position, the valve 33 disables air from flowing through the Y-fitting 31 and into the first pipe connection 30 and the pyrolyzer 20. Such use of the air blower 32 and the valve 33 during pyrolysis processes is described in more detail below.

Still referring to FIG. 1B, CPS 1 may also include a first auger 42 that is operably engaged with the first pipe connection 30. In the illustrated embodiment, the first auger 42 is positioned inside of the first pipe connection 30 where the first auger 42 extends pass the inlet end 30A to the outlet end 30B. The first auger 42 is also configured to rotate inside of the first pipe connection 30, via a motor 43 operably engaged with the first auger 42, to feed and transport biomass material from the hopper 10 to the pyrolyzer 20. More particularly, the first auger 42 rotates inside of the first pipe connection 30 to linearly move a continuous amount of biomass material at a feeding rate from the hopper 10 to the base 24 of the pyrolyzer 20; such linear movement of a continuous amount of biomass material at a feeding rate from the hopper 10 to the pyrolyzer 20 is described in more detail below.

The first auger 42 of CPS 1 may have any suitable dimensions to transfer a continuous amount of biomass material at a feeding rate from the hopper 10 to the base 24 of the pyrolyzer 20. In the illustrated embodiment, the first auger 42 may define a two-inch diameter along the entire length of the first auger 42 for transferring a continuous amount of biomass material at a feeding rate from the hopper 10 to the base 24 of the pyrolyzer 20. In this example, the first pipe connection 30 defines a diameter greater than two-inches to enable the first auger 42 to rotate inside of the first pipe connection 30 for transferring a continuous amount of biomass material at a feeding rate from the hopper 10 to the base 24 of the pyrolyzer 20. In other exemplary embodiments, a first pipe connection and a first auger of a CPS described and illustrated herein may have any suitable dimensions that enables the first auger to rotate inside of the first pipe connection for transferring a continuous amount of biomass material at a feeding rate from a hopper to a base of a pyrolyzer.

Still referring to FIG. 1C, CPS 1 may also include a second auger 44 that is operably engaged with the pyrolyzer 20. In the illustrated embodiment, the second auger 44 is positioned inside of the base 24 of the pyrolyzer 20 and partially in the main body 22 where the second auger 44 extends upwardly through the base 24 and into the main body 22. The second auger 44 is also configured to rotate inside of the base 24, via a motor 45 operably engaged with the second auger 44, to transfer biomass material from the base 24 to the main body 22. More particularly, the second auger 44 rotates inside of the base 24 to linearly move the continuous amount of biomass material at the feeding rate from the base 24 to the main body 22; such linear movement of the continuous amount of biomass material at the feeding rate from the base 24 to the main body 22 is described in more detail below.

The second auger 44 of CPS 1 may also have any suitable dimensions to transfer a continuous amount of biomass material at a feeding rate from base 24 to the main body 22. In the illustrated embodiment, the second auger 44 may define a six-inch diameter along the entire length of the second auger 44 for transferring a continuous amount of biomass material at a feeding rate from base 24 to the main body 22. In this example, the base 24 defines a diameter greater than six inches to enable the second auger 44 to rotate inside of the base 24 for transferring a continuous amount of biomass material at a feeding rate from the base 24 to the main body 22. In other exemplary embodiments, a base of a pyrolyzer and a second auger of a CPS described and illustrated herein may have any suitable dimensions that enables the second auger to rotate inside of the base for transferring a continuous amount of biomass material at a feeding rate from the base to a main body of the pyrolyzer. In one example, a second auger may only be housed inside of a base of a pyrolyzer and be positioned vertically below a main body of the pyrolyzer.

Referring to FIG. 1C, CPS 1 also includes a second pipe connection 46 that operably engages the pyrolyzer 20 to a burner 50, which is described in more detail below. As illustrated, an inlet end 46A of the second pipe connection 46 operably engages with the top end 28A of the hood 28 in which the inlet end 46A is in fluid communication with the top opening 28D of the hood 28. Such fluid communication between the second pipe connection 46 and the hood 28 enables the hood 28 to capture synthesized gas produced during the pyrolysis processes inside of the pyrolyzer 20 and transfer the captured synthesized gas from the pyrolyzer 20 to the burner 50. Additionally, an outlet end 46B of the second pipe connection 46 also operably engages with the burner 50 in which the outlet end 46B is in fluid communication with the burner 50. As such, the second pipe connection 46 is configured to transfer the synthesized gas from the hood 28 to the burner 50 for further energy use, which is described in more detail below.

Figure 2:
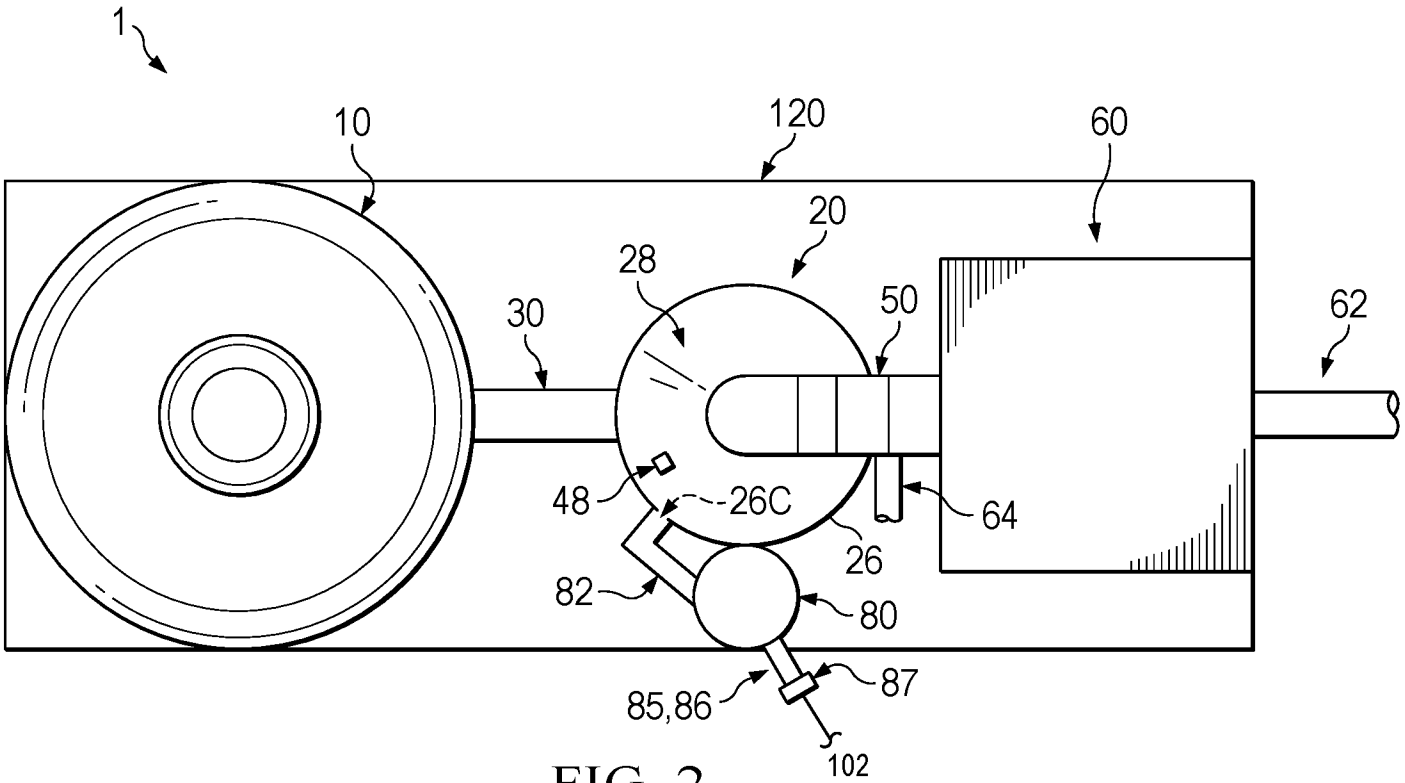
FIG. 2 is a diagrammatic top plan view of CPS shown in FIG. 1A.

Referring to FIGS. 1A-2, CPS 1 may also include at least one igniter or electric torch 48 that operably engages with one of the main body 22 and the hood 28. In the illustrated embodiment, a single igniter 48 is operably engages with the hood 28 where a portion of the igniter 48 is positioned inside of the hood 28. The igniter 48 is configured to radiantly superheat the air inside of the main body 22 and the hood 28 to ignite the biomass material housed inside of the main body 22. It should be understood that any commercially available igniter, electric torch, or device of the like may be used to radiantly superheat the air inside of a main body and hood of a pyrolyzer to ignite the biomass material housed inside of the main body.

Referring to FIGS. 1A-3, CPS 1 may also include at least one burner or static mixer 50 that operably engages with the second pipe connection 46. In the illustrated embodiment, CPS 1 includes a single burner 50 that operably engages with the second pipe connection 46. The burner 50 is also in fluid communication with the pyrolyzer 20 via the second pipe connection 46 in which the burner 50 is positioned downstream of the pyrolyzer 20. As described in more detail below, the burner 50 is configured to mix combustion air with the synthesized gas produced by pyrolyzer 20 for energy purposes in downstream devices and machines of CPS 1 or separate downstream devices and machines operably engaged with CPS 1.

Figure 3:
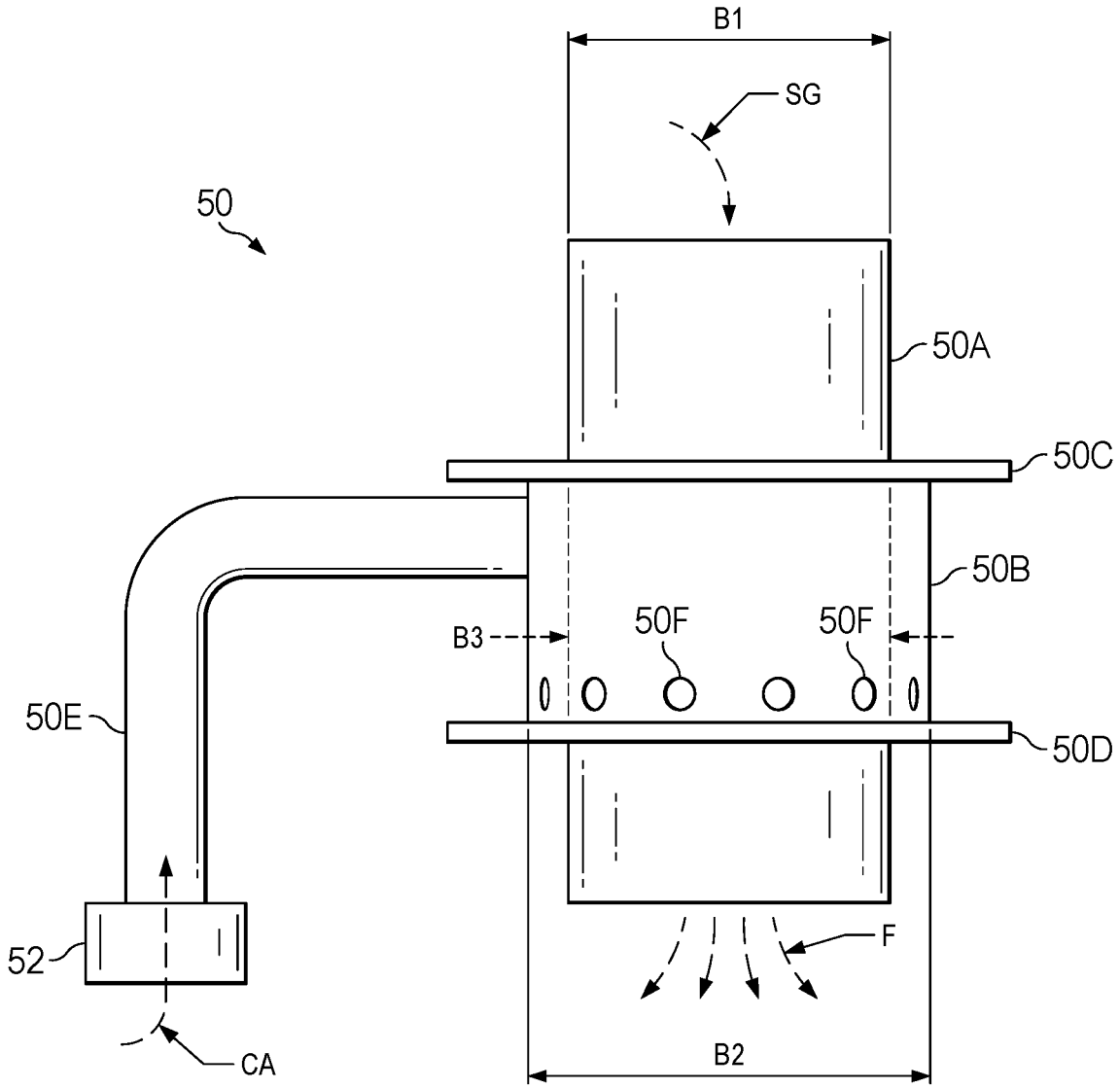
FIG. 3 is a side elevation view of a burner of CPS in accordance with an aspect of the present disclosure.

As best seen in FIG. 3, the burner 50 includes a first pipe 50A that operably engages with the second pipe connection 46 at the outlet end 46B. The first pipe 50A may also define a first diameter B1 that is continuous along the entire length of the first pipe 50A. The burner 50 also includes a second pipe 50B operably engaged with the first pipe 50A via a first flange 50C provided with the second pipe 50B. The second pipe 50B is also in fluid communication with the first pipe 50A for transferring fluids from the first pipe 50A to the second pipe 50B. The second pipe 50B may also define an outer diameter B2 that is continuous along the entire length of the second pipe 50B. In the illustrated embodiment, the second diameter B2 of the second pipe 50B is greater than the first diameter B1 of the first pipe 50A. The second pipe 50B may also define an inner diameter B3 that is continuous along the entire length of the second pipe 50B. In the illustrated embodiment, the outer diameter B3 of the second pipe 50B is greater than the first diameter B1 of the first pipe 50A. The burner 50 may also include a second flange 50D that is operably engaged with the second pipe 50B and is positioned opposite to the first flange 50C relative to the second pipe 50B. The second flange 50D is configured to operably engage the burner 50 with a heat exchanger of CPS 1 for transporting energy to the heat exchanger of CPS 1, which is described in more detail below.

Referring to FIG. 3, the burner 50 may also include an external air connection 50E that operably engages with one of the first pipe 50A and the second pipe 50B. In the illustrated embodiment, the external air connection 50E operably engages with the second pipe 50B between the first flange 50C and the second flange 50D. The external air connection 50E also defines a curvilinear shape in which a portion of the external air connection 50E is positioned on a first plane and another portion of the external air connection 50E is positioned on a second plane. The external air connection 50E is in fluid communication with the second pipe 50B such that external combustion air may be forced into the burner 50, via a fan 52, to mix with the synthesized gas outputted from the pyrolyzer 20. A set of openings 50F may also be defined in the second pipe 50B where the set of openings 50F is in fluid communication with the external air connection 50E. Such fluid communication between the set of openings 50F and the external air connection 50E enables external combustion air to be outputted from the fan 52 to the set of openings 50F to sufficiently mix the external combustion air with the synthesized gas to create and/or generate combustion energy.

The mixture of external combustion air with the synthesized gas produced by the pyrolyzer 20 is provided through any viable air movements dependent upon the structural configuration of the burner 50. In one instance, the mixture of external combustion air with the synthesized gas produced by the pyrolyzer 20 is performed by turbulent air flow created inside of the burner 50 due to the structural configuration of the burner 50.

Referring to FIGS. 1A-2, CPS 1 may also include a heat exchanger 60 that operably engages with the burner 50. As illustrated, the heat exchanger 60 is configured to receive the combustion energy generated from the burner 50 and to be used as an energy source for various reasons. In one example, the combustion energy generated by the burner 50 may be used as an energy source to heat water for CPS 1 or other systems operably engaged with CPS 1. In another example, the combustion energy generated by the burner 50 may be outputted from the heat exchanger 60 back to the burner 50, via the external air connection 50E, to repurpose and/or reuse as combustion air. It should be understood that any suitable heat exchanger that is commercially available may be used in CPS 1 for generating energy for downstream process in CPS 1 and/or other system operably engaged with CPS 1 needing an energy source.

It should be understood that heat exchanger 60 described and illustrated herein may be any suitable heat exchanger that is configured to receive the combustion energy generated from the burner 50 and to be used as an energy source for various reasons mentioned above. In one exemplary embodiment, heat exchanger 60 may be a boiler that is configured to receive the combustion energy generated from the burner 50 and to be used as an energy source for various reasons mentioned above. In another exemplary embodiment, heat exchanger 60 may be a turbine that is configured to receive the combustion energy generated from the burner 50 and to be used as an energy source for various reasons mentioned above.

In the illustrated embodiment, CPS 1 may include an insulating air jacket 62 or sleeve that is circumferentially disposed about a flue vent and/or pipe (not illustrated) of the heat exchanger 60. CPS 1 may also include a preheater connection 64 that operably engages the insulating air jacket 62 with the external air connection 50E of the burner 50 to provide combustion air to the burner 50. A fan 65 may also be operably engaged with the insulating air jacket 62 upstream of the preheater connection 64. The fan 65 may exert and/or blow ambient air into the insulating air jacket 62 to move hot air trapped inside of the insulating air jacket 62 (created from the flue vent of the heat exchanger 60) towards the preheater connection 64. As such, this structural configuration between the insulating air jacket 62 and the preheater connection 64 creates an air-to-air heat exchanger for transferring pre-heating combustion air to the burner 50 for preventive measures. In one instance, the combustion air may be used to prevent incoming synthesized gas, produced by the pyrolyzer 20, from condensing inside of the burner 50. As such, the use of this combustion air may eliminate the condensing of tars and other similar liquid of the synthesized gas from building up inside of the burner 50 during pyrolysis processes.

It should be understood that CPS 1 may utilize one or both of the fans 52, 65 during pyrolysis processes depending on various considerations, including the temperature of the combustion air, the output of synthesized gas, and other various considerations of the like. It should also be understood that CPS 1 may also omit and/or remove one of the fans 52, 65 if desired.

Referring to FIGS. 1B and 1C, CPS 1 may also include a wiper assembly 70 that may operably engage with the pyrolyzer 20 and may operably engage with the second auger 44. The wiper assembly 70 is configured to wipe and/or move biomass material from the pyrolyzer 20 once the biomass material has been synthesized to biochar material due to pyrolysis processes performed inside of the pyrolyzer 20. More particularly, the wiper assembly 70 is configured to wipe and/or move biomass material from the pyrolyzer 20, via the side opening 26C, once the biomass material has been synthesized to biochar material due to pyrolysis processes performed inside of the pyrolyzer 20. Such components that make up the wiper assembly 70 are described in more detail below.

Referring to FIG. 1C, one exemplary embodiment of the wiper assembly 70 includes at least one wiper blade or wiper member 72 that operably engages with an attachment member 74 to a drive shaft 76. As illustrated, the wiper assembly 70 includes a first wiper blade 72A that operably engages with the attachment member 74 at a first position. The wiper assembly 70 also includes a second wiper blade 72B that operably engages with the attachment member 74 at a second position opposite to the first position of the first wiper blade 72A. As illustrated, the first wiper blade 72A and the second wiper blade 72B are configured to be housed inside of the collar 26 of the pyrolyzer 20 to wipe and/or move biochar material from the pyrolyzer 20 to a quencher of CPS 1 via the side opening 26C defined in the collar 26. However, it is to be understood that other configurations of a device to move biomass material from the pyrolyzer 20 are entirely possible.

Still referring to FIG. 1C, the attachment member 74 is also operably engaged at a top end 76A of the drive shaft 76 inside of the collar 26. The drive shaft 76 may also include a bottom end 76B vertically opposite to the top end 76A in which the bottom end 76B may be operably engaged with second auger 44. Such engagement between the second auger 44 and the drive shaft 76 enables the drive shaft 76 to rotate with the second auger 44 during pyrolysis processes. As such, the second auger 44 and the wiper assembly 70 may cooperatively rotate with one another during pyrolysis processes in which the second auger 44 is feeding biomass material into the pyrolyzer 20 while the drive shaft 76 rotatably moves the first wiper blade 72A and the second wiper blade 72B to transport synthesized biochar material away from the pyrolyzer 20.

The term "feeding rate" discussed herein relates to the rate or speed at which the first auger 42 and second auger 44 rotate or spin at to supply or dispense biomass from the hopper 10 to the pyrolyzer 20. The term "feeding rate" discussed herein also relates to the rate or speed at which the wiper assembly 70 rotates or spins at to supply or dispense the second byproduct or biochar material from the pyrolyzer 20 to at least one biochar quencher, which is discussed in greater detail below. In one instance, the feeding rate of the first auger 42, second auger 44, and the wiper assembly 70 may be continuous (either a uniform speed or variable speeds) for supplying or dispensing biomass from the hopper 10 to the pyrolyzer 20 and the biochar material from the pyrolyzer 20 to at least one biochar quencher. In another instance, the feeding rate of the first auger 42, second auger 44, and the wiper assembly 70 may be incremental (either a uniform speed or variable speeds) for supplying or dispensing biomass from the hopper 10 to the pyrolyzer 20 and the biochar material from the pyrolyzer 20 to at least one biochar quencher. In another instance, the feeding rate of the first auger 42, second auger 44, and the wiper assembly 70 may pulse or tick (either a uniform speed or variable speeds) for supplying or dispensing biomass from the hopper 10 to the pyrolyzer 20 and the biochar material from the pyrolyzer 20 to at least one biochar quencher.

CPS 1 may also include at least one biochar quencher 80 that operably engages with the pyrolyzer 20. As best seen in FIG. 1C, a single biochar quencher 80 is operably engaged with the pyrolyzer 20. In other exemplary embodiments, any suitable number of biochar quenchers may be operably engaged with a pyrolyzer of a CPS. As best seen in FIG. 1C, a third pipe connection 82 may operably engage the biochar quencher 80 with the pyrolyzer 20 via the side opening 26C. The third pipe connection 82 also provides fluid communication between the biochar quencher 80 and the pyrolyzer 20 in which the third pipe connection 82 enables biochar material to be transferred from the collar 26 to the biochar quencher 80 via the wiper assembly 70. During pyrolysis processes, the biochar quencher 80 is configured to rapidly cool the biochar material upon being received from the pyrolyzer 20. In one exemplary embodiment, a biochar quencher may be a water quencher to rapidly cool synthesized biochar material via water. In other exemplary embodiments, any suitable and commercially available biochar quencher may be used in CPS 1 to rapidly cool biochar material after by synthesized during pyrolysis processes.

Referring to FIG. 2, a fourth pipe connection 85 may be operably engage with the biochar quencher 80 and be configured to house a third auger 86. In this embodiment, the third auger 86 is positioned inside of the fourth pipe connection 85 and positioned inside of the biochar quencher 80. The third auger 86 is also rotatable inside of the biochar quencher 80 and the fourth pipe connection 85, via a motor 87, where the third auger 86 is configured to elevate the biochar material from the biochar quencher 80. Such elevation of the biochar material enables any excess liquid to drain from the biochar material and back into the biochar quencher 80. As the biochar material is elevated from the biochar quencher 80, the biochar material may fall from the fourth pipe connection 85, via a side opening (not illustrated) defined in the fourth pipe connection 85, and into a container that is ready for packaging a predetermined amount of biochar material.

In an exemplary embodiment, the third auger 86 may also be used to mix cooling fluid with biochar material inside of the biochar quencher 80 to rapidly cool the biochar material subsequent to the biochar material being synthesized during pyrolysis processes.

While not illustrated herein, the fourth pipe connection 85 may provide a Y-fitting to enable external communication into the fourth pipe connection 85. In one example, the Y-fitting may provide an outlet and/or escapement to enable biochar material to be removed from the fourth pipe connection 85 as the third auger 86 elevates the biochar material from the biochar quencher 80. In this example, a container and/or bagger unit may be operably engaged with the Y-fitting or positioned directly below the Y-fitting to enable collection of the biochar material. In another example. external material and/or fluid into the fourth pipe connection 85 and with the third auger 86. Examples of cooling fluid and/or cooling material that may be injected into the Y-fitting may be water, external air, or other various cooling fluid and/or cooling material needed for quenching biochar material inside a biochar quencher.

While not illustrated herein, the fourth pipe connection 85 and the third auger 86 may be oriented and/or positioned at any suitable angle relative to the biochar quencher 80 based on various considerations, including the angle at which the third auger 86 may elevated biochar material from the biochar quencher 80 while draining excess liquid from the biochar material. In one instance, a fourth pipe connection and a third auger may be positioned at a range of angles from about zero degrees up to about ninety degrees relative to a biochar quencher. In another instance, a fourth pipe connection and a third auger may be positioned at an angle of about forty-five degrees relative to a biochar quencher.

Referring to FIG. 1A, CPS 1 may also include a control system 100 that operably engages with specific components and assemblies of CPS 1 previously described. The control system 100 may include at least one controller 102 that is configured to control specific components and assemblies of CPS 1 previously described. In one instance, the at least one controller 102 may also be operably engaged with the air blower 32 via a first electrical connection W1 for enabling the air blower 32 to force air into the Y-fitting 31. In another instance, the at least one controller 102 may be operably engaged with the motor 43 of the first auger 42 via a second electrical connection W2 for controlling the rotation of the first auger 42 during pyrolysis processes. In another instance, the at least one controller 102 may also be operably engaged with the motor 45 of the second auger 44 via a third electrical connection W3 for controlling the rotation of the second auger 44 during pyrolysis processes. In another instance, the at least one controller 102 may also be operably engaged with the motor of the third auger 86 via a fourth electrical connection for controlling the rotation of the third auger 86 during pyrolysis processes. In another instance, the at least one controller 102 may also be operably engaged with the at least one igniter 48 via a fifth electrical connection W5 for controlling the ignition of biomass material during pyrolysis processes. While not illustrated herein, fans 52, 65 may also be in electrical communication with the at least one controller 102 for enabling the at least one controller 102 to operate fans 52, 65 during pyrolysis processes.

Still referring to FIG. 1, the control system 100 may also include at least one thermometer sensor or thermocouple 104 that is operably engaged with the at least one controller 102 and the pyrolyzer 20. The at least one thermocouple 104 is configured to monitor a pyrolysis zone inside of the chamber 22D of the pyrolyzer 20 via temperature measurements to determine if biomass material should be feed into the pyrolyzer 20 during pyrolysis processes. In the illustrated embodiment, the control system 100 includes a first thermocouple 104A that is in electrical communication with the at least one controller 102 via a sixth electrical connection W6 and operably engaged at a first position with the main body 22 of the pyrolyzer 20. The control system 100 also includes a second thermocouple 104B that is in electrical communication with the at least one controller 102 via a seventh electrical connection W7 and operably engaged at a second position with the main body 22 of the pyrolyzer 20 vertically below the first thermocouple 104A. The control system 100 also includes a third thermocouple 104C that is in electrical communication with the at least one controller 102 via an eighth electrical connection W8 and operably engaged at a third position with the main body 22 of the pyrolyzer 20 vertically below the second thermocouple 104B. The control system 100 also includes a fourth thermocouple 104D that is in electrical communication with the at least one controller 102 via a ninth electrical connection W9 and operably engaged at a fourth position with the main body 22 of the pyrolyzer 20 vertically below the third thermocouple 104C. During pyrolysis processes, the first thermocouple 104A, the second thermocouple 104B, the third thermocouple 104C, and the fourth thermocouple 104D are configured to monitor and detect where the pyrolysis zone is located inside of the pyrolyzer 20 by measuring the thermal energy inside of the pyrolyzer. Such monitoring enables the at least one controller 102 to determine if biomass material needs to be feed from the hopper 10 to the pyrolyzer 20 by enable operation of the first auger 42 and the second auger 44. Such monitoring also enables the at least one controller 102 to determine if the wiper assembly 70 and the third auger need to be initiated to transport synthesized biochar material from the pyrolyzer 20 to the biochar quencher 80.

During operation, the control system 100 may be configured to rotate both the first auger 42 and the second auger 44 at any suitable speeds of rotation for feeding biomass material from the hopper 10 to the pyrolyzer 20 based on the pyrolysis zone monitored by the first thermocouple 104A, the second thermocouple 104B, the third thermocouple 104C, and the fourth thermocouple 104D. In one instance, the control system 100 may rotate the first auger 42 at a first speed of rotation and rotate the second auger 44 at a second speed of rotation where the first speed of rotation and the second speed of rotation are equal to one another. In this instance, the drive shaft 76 of the wiper assembly 70 may also have a speed of rotation that matches the second auger 44 when the drive shaft 76 and the second auger 44 are operably engaged with one another. In another instance, the control system 100 may rotate the first auger 42 at a first speed of rotation and rotate the second auger 44 at a second speed of rotation where the first speed of rotation is different than the second speed of rotation.

During operation, the control system 100 may also be configured to enable the air blower 32 to exert air into the pyrolyzer 20 based on the pyrolysis zone monitored by the first thermocouple 104A, the second thermocouple 104B, the third thermocouple 104C, and the fourth thermocouple 104D. In one instance, the control system 100 may enable the fan to exert air into the pyrolyzer 20 when the pyrolysis zone is outside a predetermined height inside of the pyrolyzer 20 measured by one or all of by first thermocouple 104A, the second thermocouple 104B, the third thermocouple 104C, and the fourth thermocouple 104D. In another instance, the control system 100 may disable the fan from exerting air into the pyrolyzer 20 when the pyrolysis zone is within a predetermined height inside of the pyrolyzer 20 measured by one or all of the first thermocouple 104A, the second thermocouple 104B, the third thermocouple 104C, and the fourth thermocouple 104D.

During operation, the control system 100 may also be configured to rotate both the third auger at any suitable speeds of rotation for transferring biochar material from the pyrolyzer 20 to the biochar quencher 80 based on the pyrolysis zone monitored by the first thermocouple 104A, the second thermocouple 104B, the third thermocouple 104C, and the fourth thermocouple 104D. In one instance, the control system 100 may rotate the third auger at a third speed of rotation to mix the biochar material and the water inside of the biochar quencher 80. In this instance, the third speed of rotation may match the first speed of rotation of the first auger 42 and the second sped of rotation of the second auger 44. In another instance, the control system 100 may rotate the third auger at a third speed of rotation where the third speed of rotation is different than the first speed of rotation of the first auger 42 and the second sped of rotation of the second auger 44.

Referring to FIGS. 1A and 1B, CPS 1 may include a support structure 120 that holds and maintains each component of CPS 1. As best seen in FIG. 2, each of the hopper 10, the pyrolyzer 20, burner 50, heat exchanger 60, and biochar quencher 80 may be operably engaged with the support structure 120. While not illustrated herein, the at least one controller 102 may also be operably engaged with the support structure 120.

The support structure 120 may also include a set of wheels 122 to enable an operator and/or user to move the support structure 120 to various locations if desired. In other words, an operator of CPS 1 may move CPS 1 to any suitable location and/or position based on various needs and requirements for a specific setting in which CPS 1 is being used.

Having now described the assemblies and components of CPS 1, methods of synthesizing biochar material and synthesized gas with CPS 1 are described in more detail below.

Prior to initiating a pyrolysis process, the control system 100 may initiate the first auger 42 to feed a continuous amount of biomass material at a first rate and/or first speed of rotation from the hopper 10 to the base 24 of the pyrolyzer 20. The control system 100 may also initiate the second auger 44 to feed the continuous amount of biomass material at a second rate and/or second speed of rotation from the base 24 of the pyrolyzer 20 into the main body 22 of the pyrolyzer 20. The operator of CPS 1 may then initiate the pyrolysis process inside of the pyrolyzer 20 by igniting the biomass material at one of the top end 22A of the main body 22, inside the collar 26, or inside the hood 28 given the pyrolyzer 20 is a TLUD pyrolyzer 20.

Once the pyrolysis process begins, the control system 100 continuously controls the air blower 32, the first auger 42, the second auger 44, and the third auger along with continuously monitoring the pyrolysis zone inside of the main body 22 via the first thermocouple 104A, the second thermocouple 104B, the third thermocouple 104C, and the fourth thermocouple 104D. The at least one controller 102 may be programmed to initiate one or all of the air blower 32, the first auger 42, and the second auger 44 when the pyrolysis zone is outside of a predetermined height measured by at least one thermocouple 104. In one instance, the at least one controller 102 may enable the air blower 32 to exert air into the pyrolyzer 20 so the pyrolysis zone is maintained within the predetermined height inside of the main body 22 measured by at least one thermocouple 104. In another instance, the at least one controller 102 may also initiate rotation of the first auger 42 and the second auger 44 to feed biomass material into the pyrolyzer 22 so the pyrolysis zone is maintained within the predetermined height inside of the main body 22 measured by at least one thermocouple 104. Such rotation of the second auger 44 may also initiate rotation of the drive shaft 76 of the wiper assembly 70 causing the first wiper blade 72A and the second wiper blade 72B to transfer biochar material from the pyrolyzer 20 to the biochar quencher 80. The control system 100 may continuously control and monitor the pyrolysis zone until the pyrolysis process is complete.

The use of air blower 32 during pyrolysis processes is considered advantageous at least because the air blower 32 may be used to modulate and/or control the output of one of both of the first byproduct (synthesized gas) and the second byproduct (biochar material). As such, the air blower 32 may be used to control the modulation of the pyrolysis zone inside of the main body 22 to either increase or decrease the output of one of both of the first byproduct and the second byproduct. In one instance, air blown into the main body 22 at a first speed by the air blower 32 may vertically elevate the pyrolysis zone inside of the main body 22 to increase the output of one of both of the first byproduct and the second byproduct by vertically elevating the pyrolysis zone into a greater circumferential area inside of the conical shape or frustoconical shape pyrolyzer 20. In another instance, the air blown into the main body 22 at a second speed by the air blower 32 may vertically lower the pyrolysis zone inside of the main body 22 to decrease the output of one of both of the first byproduct and the second byproduct by vertically lowering the pyrolysis zone into a smaller circumferential area inside of the conical shape or frustoconical shape pyrolyzer 20. Such modulation of the pyrolysis zone by inside of the pyrolyzer 20 by the air blower 32 may due to various reasons, including the amount of biomass material delivered to the pyrolyzer 20.

The use of the first auger 42 and the second auger 44 during pyrolysis processes is considered advantageous at least because the first auger 42 and the second auger 44 may also be used to modulate and/or control the output of one of both of the first byproduct (synthesized gas) and the second byproduct (biochar material). As such, the first auger 42 and the second auger 44 may be used to control the modulation of the pyrolysis zone inside of the main body 22 to either increase or decrease the output of one of both of the first byproduct and the second byproduct. In one instance, the first auger 42 and the second auger 44 may continuously feed biomass at a first rate inside of the main body 22 to vertically elevate the pyrolysis zone inside of the main body 22. Such vertical elevation of the biomass material increases the output of one of both of the first byproduct and the second byproduct when vertically elevating the pyrolysis zone into a greater circumferential area inside of the conical shape or frustoconical shape pyrolyzer 20. In another instance, the first auger 42 and the second auger 44 may continuously feed biomass material at a second rate inside of the main body 22 to vertically lower the pyrolysis zone inside of the main body 22. Such vertical lowering of the biomass material decreases the output of one of both of the first byproduct and the second byproduct when vertically lowering the pyrolysis zone into a smaller circumferential area inside of the conical shape or frustoconical shape pyrolyzer 20. Such modulation of the pyrolysis zone by inside of the pyrolyzer 20 by the first auger 42 and the second auger 44 may due to various reasons, including the amount of biomass material delivered to the pyrolyzer 20.

During this pyrolysis process, synthesized gas is produced from the biomass material inside of the pyrolyzer 20. The synthesized gas is captured by the hood 28 of the pyrolyzer 20 and is transferred to the burner 50 that is downstream of the pyrolyzer 20. As the synthesized gas passes through the burner 50, combustion air is emitted into the burner 50, via the fan 52 exerting combustion air into the external air connection 50E and the openings 50F, to turbulently mix with the synthesized gas prior to being transferred into the heat exchanger 60. Upon mixture, the burner 50 outputs combustion energy to the heat exchanger 60. The heat exchanger 60 then uses this combustion energy as an energy source to be used with other devices and/or machines in CPS 1 or other systems operably engaged with the CPS 1. The combustion air produced by the heat exchanger 60 may also be recirculated to the burner 50, via external air connection 50E of the burner 50, for continuously using combustion air.

Figure 4:
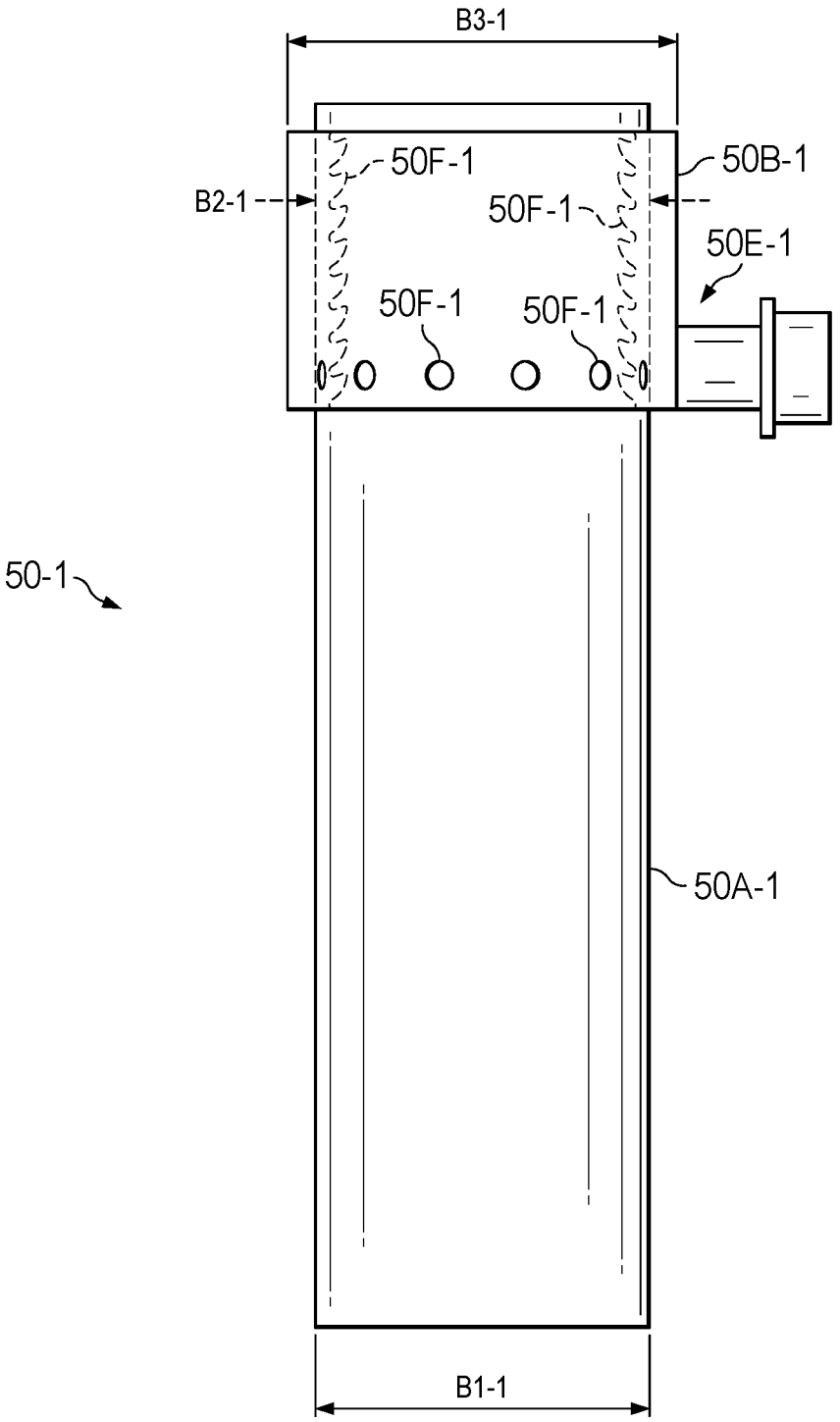
FIG. 4 is a side elevation view of an alternative burner of CPS in accordance with another aspect of the present disclosure.

FIG. 4 illustrates an alternative burner 50-1 that is similar to burner 50 described above and illustrated in FIG. 3, except as detailed below. Burner 50-1 includes a first pipe 50A-1 that is configured to operably with the second pipe connection 46 and the heat exchanger 60. The first pipe 50A-1 also defines a diameter B1-1 that is continuous along the entire length of the first pipe 50A-1. The burner 50-1 also includes a second pipe 50B-1 that operably engaged with the first pipe 50A-1. The second pipe 50B-1 defines an inner diameter B2-1 that is continuous along the entire length of the second pipe 50B-1 where the inner diameter B2-1 is equal with the diameter of the first pipe 50A-1. The second pipe 50B-1 defines an outer diameter B3-1 that is continuous along the entire length of the second pipe 50B-1 where the outer diameter B3-1 is greater than the diameter of the first pipe 50A-1. The burner 50-1 also includes an external air connection 50E-1 that operably engages with the second pipe 50B-1 in which the pipe 50A-1 and the external air connection 50E-1 are in fluid communication with one another. The external air connection 50E-1 also defines a substantially straight configuration in which the entire external air connection 50E-1 is defined along a single plane. The external air connection 50E-1 also defines a plurality of openings 50E-1 that enables mixture of combustion air with synthesized gas produced during pyrolysis processes.

Figure 5:
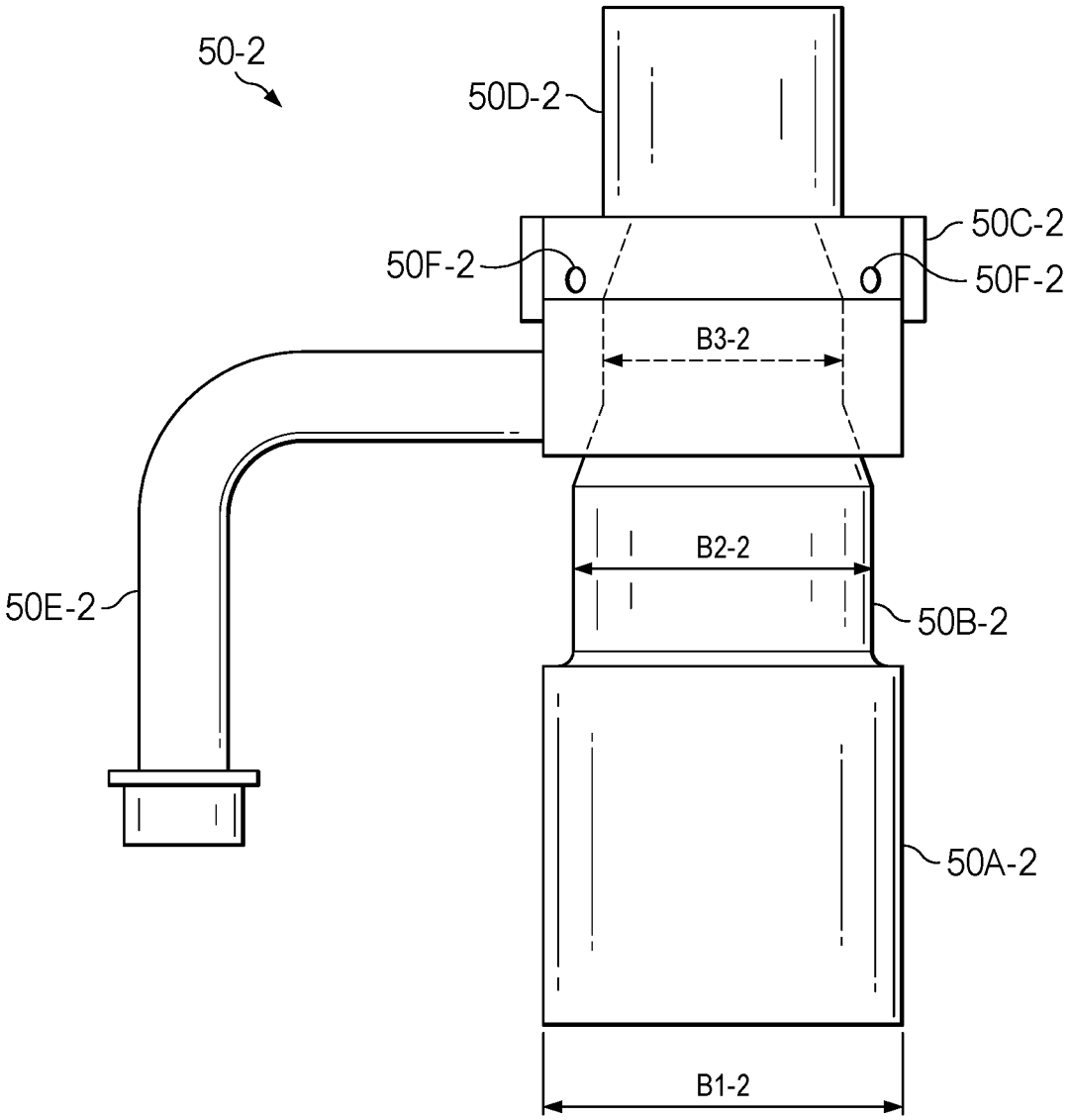
FIG. 5 is a side elevation view of another alternative burner of CPS in accordance with another aspect of the present disclosure.

FIG. 5 illustrates another alternative burner 50-2 that is similar to burner 50 described above and illustrated in FIG. 3, except as detailed below. Burner 50-2 includes a first pipe 50A-2 that is configured to operably with the second pipe connection 46. The first pipe 50A-2 also defines a first diameter B1-2 that is continuous along the first pipe 50A-2. Burner 50-2 also includes a second pipe 50B-2 that is operably engaged with the first pipe 50A-2 and is downstream of the second pipe connection 46. The second pipe 50B-2 also defines a second diameter B2-2 that is continuous along the second pipe 50B-2 and is less than the first diameter B1-2 of the first pipe 50A-2. Burner 50-2 also includes a third pipe 50C-2 that operably engages with the second pipe 50B-2 and is downstream of the second pipe connection 46. The third pipe 50C-2 also defines a third diameter B3-2 that is asymmetrical along the length third pipe 50C-2 where any portion of the third diameter B3-2 is less than the first diameter B1-2 and the second diameter B2-2. Burner 50-2 also includes an external air connection 50E-2 that operably engages with the third pipe 50C-2 in which the third pipe 50C-2 and the external air connection 50E-2 are in fluid communication with one another. Additionally, burner 50-2 may also define a plurality of openings 50F-2 in the third pipe 50C-2 that provides fluid communication between the third pipe 50C-2 and the external air connection 50E-2 that enables mixture of combustion air with synthesized gas produced during pyrolysis processes.

Figure 6:
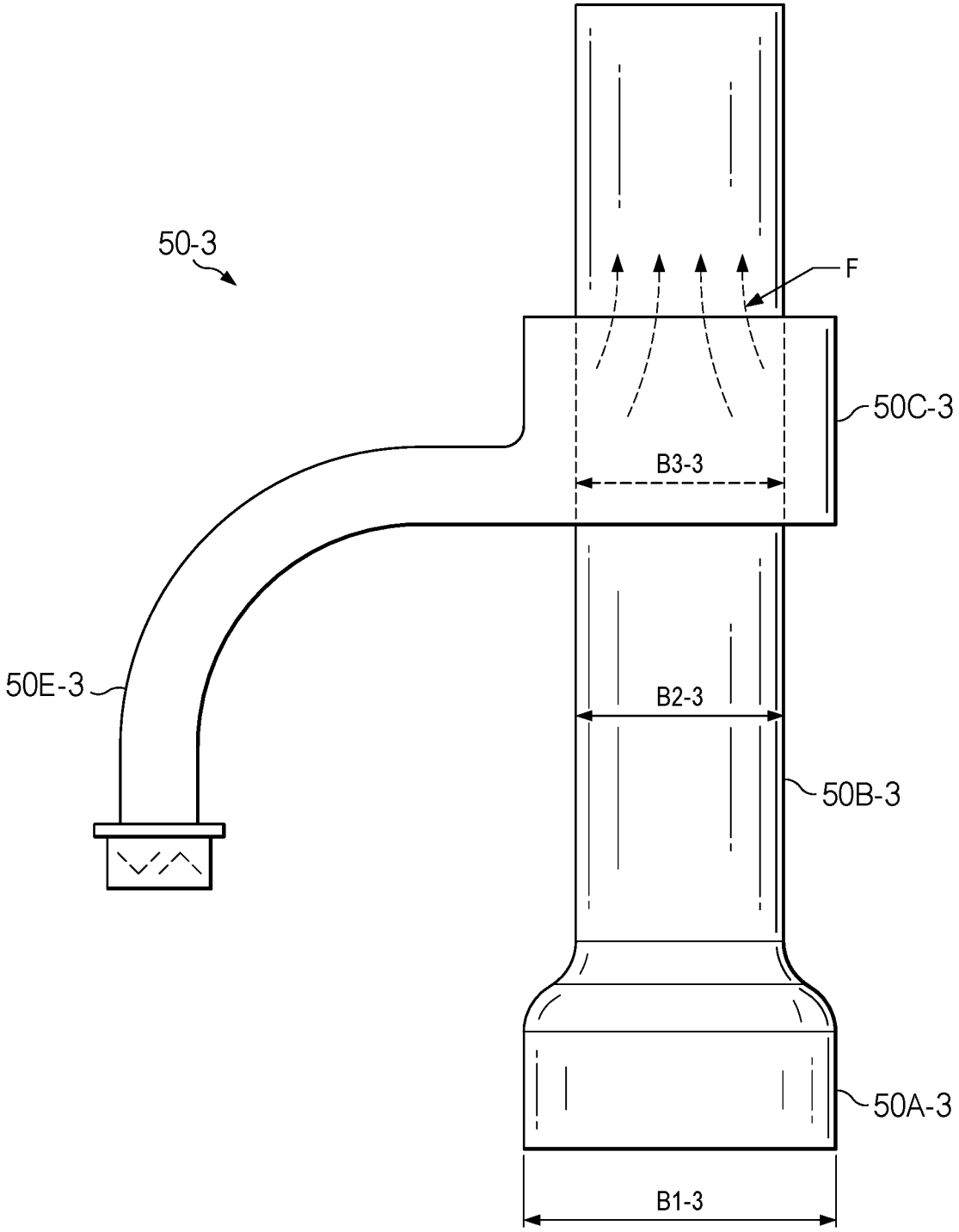
FIG. 6 is a side elevation view of another alternative burner of CPS in accordance with another aspect of the present disclosure.

FIG. 6 illustrates another alternative burner 50-3 that is similar to burner 50 described above and illustrated in FIG. 3, except as detailed below. Burner 50-3 includes a first pipe 50A-3 that is configured to operably with the second pipe connection 46. The first pipe 50A-3 also defines a first or outer diameter B1-3 that is continuous along the first pipe 50-3. Burner 50-3 also includes a second pipe 50B-3 that is operably engaged with the first pipe 50A-3 and is downstream of the second pipe connection 46. The second pipe 50-3 also defines a second or outer diameter B2-3 that is continuous along the second pipe 50B-3 and is less than the first diameter B1-3 of the first pipe 50A-3. Burner 50-3 also includes a third pipe 50C-3 that is operably engaged with the second pipe 50B-3 and is downstream of the second pipe connection 46. The third pipe 50C-3 also defines a third or inner diameter B3-3 that is continuous along the third pipe 50C-3 and is less than the first diameter B1-3 of the first pipe 50A-3 and equal with the second diameter B2-3 of the second pipe 50B-3.

Burner 50-3 also includes an external air connection 50E-3 that circumferentially engages about the second pipe 50B-3 in which the external air connection 50E-3 is in fluid communication with the second pipe 50B-3 and the third pipe 50C-3. A plurality of openings (not illustrated) may also be defined in the third pipe 50C-3 that provides fluid communication between the third pipe 50C-3 and the external air connection 50E-3 to enable mixture of combustion air with synthesized gas produced during pyrolysis processes. It should be understood that any openings defined by a pipe of any burner discussed and illustrated herein may be formed and/or defined in the third pipe 50C-3.

Figure 7:
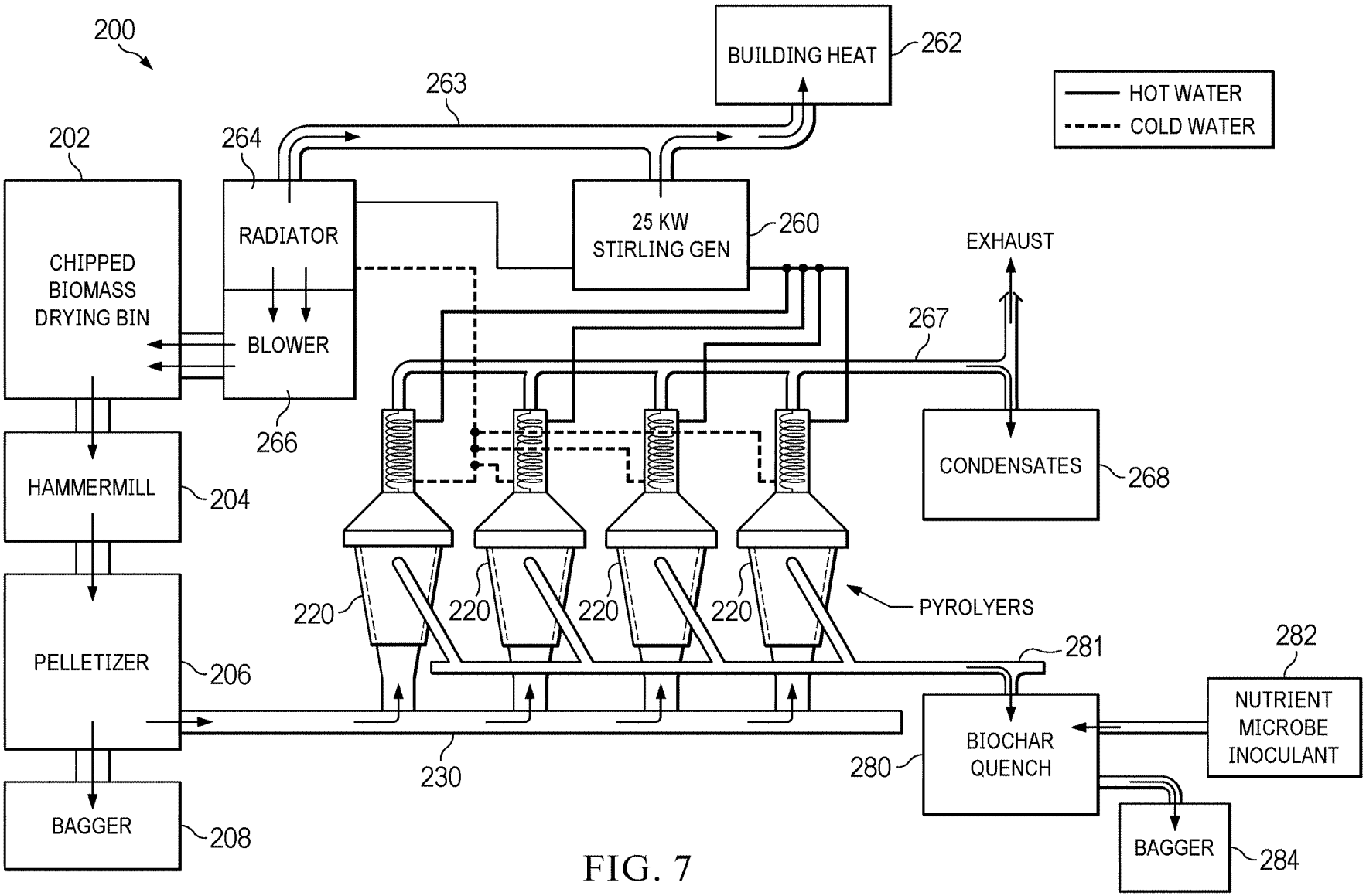
FIG. 7 is a diagrammatic view of another CPS in accordance with another aspect of the present disclosure.

FIG. 7 illustrates CPS 200 for synthesizing biomass material into an energy source for at least one heat exchanger and for synthesizing biomass material into biochar material. CPS 200 is similar to CPS 1 as described above and illustrated in FIG. 1-3, except as detail below.

As illustrated, CPS 200 may include a chipped biomass drying bin 202 (CBDB) that is configured to hold bulk biomass material suitable for being synthesized into an energy source and/or biochar material via pyrolysis processes. CBDB 202 may be any suitable CBDB that is commercially available for holding a bulk amount of biomass material suitable for being synthesized into an energy source and/or biochar material via pyrolysis processes.

CPS 200 may also include a hammer mill machine 204 that is operably engaged with CBDB 202. The hammer mill machine 204 is configured to crush various types of biomass material, including wood, boards, and other raw material into crushed form. The hammer mill machine 204 provided in CPS 200 may be any suitable hammer mill machine that is commercially available for crushing various types of biomass material, including wood, boards, and other raw material into crushed form.

CPS 200 may also include a pelletizer 206 that is operably engaged with the hammer mill machine 204 and is downstream of CBDB 202. The pelletizer 206 is configured to process crushed biomass material into pellet-sized biomass material. Such processing of crushed biomass material into pellet-sized biomass material enables ease of feeding and/or transporting such biomass material into downstream machines that initiate pyrolysis processes, which are described in more detail below. The pelletizer 206 provided in CPS 200 may be any suitable pelletizer that is commercially available for processing crushed biomass material into pellet-sized biomass material. CPS 200 may also include a bagger unit 208 that is operably engaged with the pelletizer 206 for receiving and bagging bulk amount of pellet-sized biomass material processed by the pelletizer 206.

While not illustrated herein, CPS 200 may include at least one hopper (e.g., hopper 10 in CPS 1) that is configured to hold a predetermined amount of pellet-sized biomass material processed by the pelletizer 206. The at least one hopper may be downstream from the pelletizer 206 if inputted into CPS 200.

CPS 200 may also include at least one top-lit updraft pyrolyzer 220 that is operably engaged with the pelletizer 206 and is in fluid communication with the pelletizer 206. In the illustrated embodiment, four pyrolyzer 220 are operably engaged with the pelletizer 206 and are in fluid communication with the pelletizer 206. During pyrolysis processes, pellet-sized biomass material may be feed from the pelletizer 206 to the pyrolyzers 220 via piping connections 230 operably engaging the pelletizer 206 with each pyrolyzer 220. Devices and/or machines may also be housed inside of these piping connections 230 for feeding and/or transporting pellet-sized biomass material from the pelletizer 206 to the four pyrolyzers 220 (e.g. augers 42 of CPS 1).

The pyrolyzers 220 may be any suitable pyrolyzer for synthesizing biomass material into an energy source and/or biochar material. In one instance, each pyrolyzer 220 of CPS 200 may be a pyrolyzer described and illustrated herein (e.g., pyrolyzer 20). In this same instance, devices and/or machines may be operably engaged with each pyrolyzer 220 for feeding and/or transporting pellet-sized biomass material into the pyrolyzer 220 (e.g., second auger 44).

CPS 200 also includes at least one generator and/or power supply 260 that is operably engaged with each pyrolyzer 220 where the generator 260 and the pyrolyzers 220 are in fluid communication with one another. As illustrated, the pyrolyzers 220 are configured to heat water via synthesized gas produced by the pyrolysis processes inside the pyrolyzers 220. Such heated water is transported to the generator 260 for generating and/or producing various energy sources. In one example, the heated water may be used to provide heat to a building heating system 262 operably engaged with CPS 200 via piping connection 263. In another example, the heated water may be transported to a radiator 264 in which the energy harvested by the radiator 264 is transported to the building heating system 262 or to a blower 266 operably engaged with the radiator 264. The blower 266 may exert this hot air captured by the radiator 264 into the CBDB 202 for drying chipped biomass material. The remaining synthesized gas produced by the pyrolysis processes inside the pyrolyzers 220 may be exhausted into the external environment or to condensates 268 via piping connections 267.

In other exemplary embodiments, CPS 200 may also include at least one burner that is operably engaged with the at least one pyrolyzer 220. In one example, a burner is operably engaged with each pyrolyzer 220 in CPS 200 for mixing synthesized gas, produced by pyrolysis processes in each pyrolyzer 220, with combustion gas to heat a heat exchanger or similar devices of the like as an energy source (e.g., burner 50).

CPS 200 may also include at least one biochar quencher 280 that is operably engaged with the pyrolyzers 220 via piping connections 281. The at least one biochar quenchers 280 may be used for rapidly cooling biochar material synthesized during pyrolysis processes inside the pyrolyzers 220. While not illustrated herein, each pyrolyzer 220 may include a wiper assembly (e.g., wiper assembly 70 in CPS 1) that is configured to wipe and/or move biochar material from the pyrolyzer 220 to the biochar quencher 280. The biochar material housed inside of the biochar quencher 280 may be operably engaged with a nutrient microbe inoculant treatment 282 as the biochar material is rapidly cooling. The biochar quencher 280 may also be operably engaged with a bagger unit 284 that is configured to receive and store a predetermined amount of biochar material once cooled by the biochar quencher 280.

It should be understood that the first byproduct and/or synthesized gas produced by any CPS described and illustrated herein (e.g., CPS 1, CPS 200) may be outputted to various machines and devices for various energy and/or fuel utilizations. In one instance, the hot air emitted by the first byproduct and/or synthesized gas produced by a CPS described and illustrated may be outputted to heat exchangers, drive engines using turbines, Rankine drive engines, Stirling drive engines, another other suitable machines of the like that utilize hot air for operation. In another instance, the first byproduct and/or synthesized gas may be condensed from a gaseous state to a liquid state (via at least one condensing machine). Such condensing of the synthesized gas may be utilized with other fuel products, including oil, various fuels, and other chemical products that may benefit from the synthesized gas.

It should be understood that any suitable biomass material may be used for performing pyrolysis processes to create synthesized gas and biochar material with any CPS described and illustrated herein, including CPS 1, 200. Examples of suitable biomaterial material that may be used for performing pyrolysis processes to create synthesized gas and biochar material include unpelletized woody biomass (e.g., nut shells, seeds, grains, screened chips, and other biomass material of the like) at any suitable shape, size, and density that is suitable for any CPS described and illustrated herein.

Figure 8:
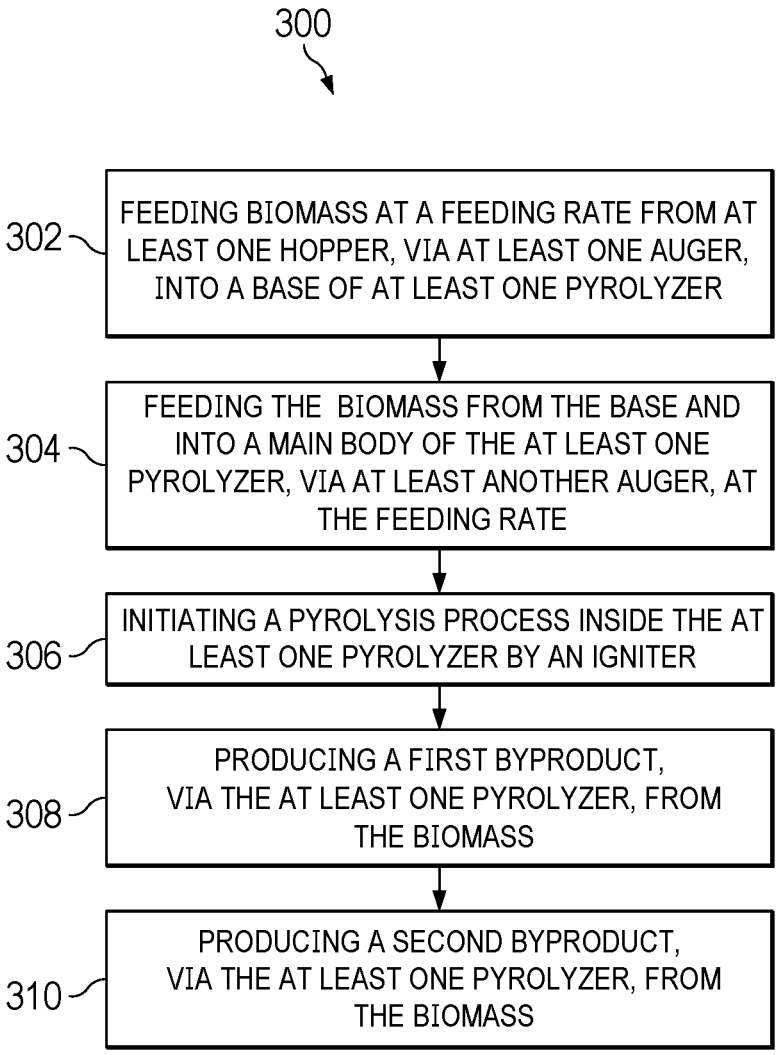
FIG. 8 is an exemplary method flowchart.

FIG. 8 illustrates a method 300. An initial step 302 of method 300 may include feeding biomass at a feeding rate from at least one hopper, via at least one auger, into a base of at least one pyrolyzer. Another step 304 of method 300 may include feeding the biomass from the base and into a main body of the at least one pyrolyzer, via at least another auger, at the feeding rate. Another step 306 of method 300 may include initiating a pyrolysis process inside the at least one pyrolyzer by an igniter. Another step 308 of method 300 may include producing a first byproduct, via the at least one pyrolyzer, from the biomass. Another step 310 of method 300 may include producing a second byproduct, via the at least one pyrolyzer, from the biomass, wherein the second byproduct is different than the first byproduct.

In other exemplary embodiments, additional steps and/or optional steps may be further included in method 300. An optional step of method 300 may further include monitoring a pyrolysis zone of the pyrolysis process, by a control system, inside of the at least one pyrolyzer. Another optional step of method 300 may further include maintaining one or both of the at least one auger and the at least another auger at the feeding rate, via the control system, when the pyrolysis zone is at a desired thermocouple of a set of thermocouples of the control system, wherein the feeding rate is continuous. Another optional step of method 300 may further include altering one or both of the at least one auger and the at least another auger from the feeding rate to a second feeding rate, via the control system, when the pyrolysis zone is one of below or above a desired thermocouple of a set of thermocouples of the control system; wherein the second feeding rate is different than the feeding rate. Another optional step of method 300 may further include moving the first byproduct, by a wiper assembly, from the at least one pyrolyzer to at least one biomass quencher. Another optional step of method 300 may further include capturing the second byproduct by a hood of the at least one pyrolyzer; mixing the second byproduct with external combustion air from a burner to create combustion energy; and outputting the combustion energy from the burner to at least one heat exchanger.

As described herein, aspects of the present disclosure may include one or more electrical, pneumatic, hydraulic, or other similar secondary components and/or systems therein. The present disclosure is therefore contemplated and will be understood to include any necessary operational components thereof. For example, electrical components will be understood to include any suitable and necessary wiring, fuses, or the like for normal operation thereof. Similarly, any pneumatic systems provided may include any secondary or peripheral components such as air hoses, compressors, valves, meters, or the like. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A pyrolysis system, comprising:

at least one hopper configured to hold biomass;

at least one pyrolyzer operably engaged with the at least one hopper and configured to receive the biomass from the at least one hopper at a feeding rate to convert the biomass into a first byproduct and a second byproduct different than the first byproduct; the at least one pyrolyzer having:

a main body for storing the biomass and synthesizing the biomass into the first byproduct and the second byproduct, the main body comprises:

a top end defining a first diameter;

a bottom end defining a second diameter that is less than the first diameter; and at least one wall extending between the top end and the bottom end and defining a chamber therebetween; wherein the at least one wall defines a frustoconical shape between the top end and the bottom end; and a base operably engaged with the bottom end of the main body; wherein the base is configured to feed the biomass into the chamber of the main body at the bottom end at the feeding rate;

a collar operably engaged with the top end of the main body; and a hood operably engaged with the collar and positioned vertically above the top end of the main body; wherein the hood is configured to direct the first byproduct to the at least one heat exchanger; and wherein the collar is configured to direct the second byproduct to the at least one biochar quencher;

at least one heat exchanger operably engaged with the at least one pyrolyzer and configured to receive the first byproduct synthesized by the at least one pyrolyzer;

a burner operably engaged with the at least one pyrolyzer and the at least one heat exchanger by a pipe connection and being positioned external to the at least one pyrolyzer; wherein the burner is configured to mix external combustion air with the first byproduct synthesized by the at least one pyrolyzer; and at least one biochar quencher operably engaged with the at least one pyrolyzer and configured to receive the second byproduct synthesized by the at least one pyrolyzer at the feeding rate.

2. The pyrolysis system of claim 1, wherein the hood comprises:

a top end of the hood defining a top opening with a first diameter;

a bottom end of the hood defining a bottom opening with a second diameter that is greater than the first diameter; and at least one wall of the hood extending between the top end and the bottom end and defining a chamber therebetween;

wherein the at least one wall of the hood defines a frustoconical shape between the bottom end and the top end.

3. The pyrolysis system of claim 1, further comprising:

a first auger operably engaged with and positioned inside of a first pipe connection for feeding the biomass from the hopper to the at least one pyrolyzer at the feeding rate; and a second auger operably engaged with and positioned inside of the at least one pyrolyzer for feeding the biomass from the first auger into the at least one pyrolyzer at the feeding rate.

4. The pyrolysis system of claim 3, further comprising:

a wiper assembly operably engaged with the second auger and positioned inside of the at least one pyrolyzer;

wherein the wiper assembly is configured to move the second byproduct from the at least one pyrolyzer to the at least one biochar quencher at the feeding rate.

5. The pyrolysis system of claim 1, wherein the burner comprises:

a first pipe operably engaged with the pipe connection and the at least one heat exchanger;

a second pipe operably engaged with the first pipe and in fluid communication with the first pipe by a set of openings defined along a portion of the second pipe;

an external air connection operably engaged with the second pipe and in fluid communication with the second pipe by the set of openings to deliver the external combustion air; and a fan operably engaged with the external air connection to input the external combustion air through the set of openings defined in the second pipe.

6. The pyrolysis system of claim 1, wherein the burner comprises:

a first pipe operably engaged with the pipe connection and the at least one heat exchanger;

a second pipe operably engaged with the first pipe and in fluid communication with the first pipe by a set of openings defined along an entire length of the second pipe;

an external air connection operably engaged with the second pipe and in fluid communication with the second pipe by the set of openings to deliver the external combustion air; and a fan operably engaged with the external air connection to input the external combustion air through the set of openings defined in the second pipe.

7. The pyrolysis system of claim 1, wherein the burner comprises:

a first pipe operably engaged with the pipe connection and the at least one heat exchanger;

a second pipe operably engaged with the first pipe and in fluid communication with the first pipe;

a third pipe operably engaged with and in fluid communication with the second pipe and defining a set of openings;

an external air connection operably engaged with the third pipe and in fluid communication with the third pipe by the set of openings to deliver the external combustion air; and a fan operably engaged with the external air connection to input the external combustion air through the set of openings.

8. The pyrolysis system of claim 1, wherein the burner comprises:

a first pipe operably engaged with the pipe connection and the at least one heat exchanger;

a second pipe operably engaged with the first pipe and in fluid communication with the first pipe;

a third pipe operably engaged about and in fluid communication with the second pipe and defining a set of openings;

an external air connection operably engaged with the third pipe and in fluid communication with the third pipe by the set of openings to deliver the external combustion air; and a fan operably engaged with the external air connection to input the external combustion air through the set of openings.

9. The pyrolysis system of claim 2, further comprising:

an igniter operably engaged with the at least one wall of the hood between the top end and the bottom end;

wherein the igniter is configured to ignite the biomass inside of the at least one pyrolyzer.

10. The pyrolysis system of claim 1, wherein the at least one pyrolyzer is a top-lit up-draft style pyrolyzer.

11. A method, comprising:

feeding biomass at a feeding rate from at least one hopper, via at least one auger, into a base of at least one pyrolyzer;

feeding the biomass from the base and into a chamber of a main body of the at least one pyrolyzer, via at least another auger, at the feeding rate, the main body comprises:

a top end defining a first diameter;

a bottom end defining a second diameter that is less than the first diameter and operably engaged with the base; and at least one wall extending between the top end and the bottom end and defining the chamber therebetween; wherein the at least one wall defines a frustoconical shape between the top end and the bottom end;

initiating a pyrolysis process inside the at least one pyrolyzer by an igniter;

producing a first byproduct, via the at least one pyrolyzer, from the biomass;

producing a second byproduct, via the at least one pyrolyzer, from the biomass, wherein the second byproduct is different than the first byproduct;

directing the first byproduct by a hood of the at least one pyrolyzer to at least one heat exchanger, wherein the hood is positioned vertically above the top end of the main body;

directing the second byproduct by a collar of the at least one pyrolyzer to at least one biochar quencher, wherein the collar operably engages with the top end of the main body and the hood; and mixing the second byproduct with external combustion air from a burner to create combustion energy, wherein the burner operably engages with the at least one pyrolyzer and the at least one heat exchanger by a pipe connection and being positioned external to the at least one pyrolyzer.

12. The method of claim 11, further comprising:

moving the first byproduct, by a wiper assembly, from the at least one pyrolyzer to the at least one biomass quencher.

13. The method of claim 11, further comprising:

capturing the second byproduct by a hood of the at least one pyrolyzer; and outputting the combustion energy from the burner to the at least one heat exchanger.

14. The method of claim 11, further comprising:

monitoring a pyrolysis zone of the pyrolysis process, by a set of thermocouples of a control system, inside of the at least one pyrolyzer;

wherein the set of thermocouples monitors the pyrolysis zone in at least two vertical positions inside of the at least one pyrolyzer to maintain the pyrolysis zone between the at least two vertical positions.

15. The method of claim 14, further comprising:

maintaining one or both of the at least one auger and the at least another auger at the feeding rate, via the control system, when the pyrolysis zone is at a desired thermocouple of the set of thermocouples of the control system, wherein the feeding rate is continuous.

16. The method of claim 14, further comprising:

altering one or both of the at least one auger and the at least another auger from the feeding rate to a second feeding rate, via the control system, when the pyrolysis zone is one of below or above a desired thermocouple of the set of thermocouples of the control system;

wherein the second feeding rate is different than the feeding rate.

* * * * *